US012758886B2

(12) United States Patent
Parr et al.

(10) Patent No.: US 12,758,886 B2
(45) Date of Patent: Oct. 13, 2026

(54) RIDE VEHICLE DECOUPLING CONTROL SYSTEM AND METHOD

(71) Applicant: Universal City Studios LLC, Universal City, CA (US)

(72) Inventors: Eric Rae Parr, Orlando, FL (US); Eric Allan Vance, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 636 days.

(21) Appl. No.: 18/141,151

(22) Filed: Apr. 28, 2023

(65) Prior Publication Data

US 2024/0359108 A1 Oct. 31, 2024

(51) Int. Cl.
*A63G 7/00* (2006.01)
*B61G 3/08* (2006.01)

(52) U.S. Cl.
CPC ..... *A63G 7/00* (2013.01); *B61G 3/08* (2013.01)

(58) Field of Classification Search
CPC ..... B61L 13/045; B61G 3/08; A63G 7/00
See application file for complete search history.

(56) References Cited

U.S. PATENT DOCUMENTS 301,119 A * 7/1884 Haskins et al. ..... E01B 25/26 104/103
392,303 A * 11/1888 Banta et al. ..... B61G 3/08 213/219
1,190,520 A * 7/1916 Currier ..... B61L 13/045 246/186
1,252,047 A * 1/1918 Spiess ..... B61L 13/045 246/123
1,610,800 A * 12/1926 Lavarack ..... B61L 13/045 200/86 R
5,346,239 A 9/1994 Wohlhiiter
5,623,878 A 4/1997 Baxter et al.
7,836,829 B2 11/2010 Burger
11,241,633 B2 * 2/2022 Bloomfield ..... A63G 21/20
11,345,198 B2 5/2022 Delgado et al.
11,768,505 B2 * 9/2023 White ..... B60D 1/01 701/23

(Continued)

FOREIGN PATENT DOCUMENTS

CA 2611235 A1 1/2007
CN 106608309 A 5/2017

OTHER PUBLICATIONS

PCT/US2024/026017 International Search Report and Written Opinion mailed Sep. 5, 2024.

*Primary Examiner* — S. Joseph Morano
*Assistant Examiner* — Maxwell L Meshaka
(74) *Attorney, Agent, or Firm* — Fletcher Yoder, P.C.

(57) ABSTRACT

A ride system includes a track, a ride vehicle assembly, a coupling, and an actuation assembly. The ride vehicle assembly includes a first ride vehicle configured to move along the track and a second ride vehicle configured to move along the track. The coupling is configured to block a decoupling of the first ride vehicle from the second ride vehicle in response to the ride vehicle assembly being in a first interval of the track. The actuation assembly may be configured to actuate the coupling to cause a decoupling of the first ride vehicle from the second ride vehicle in response to the ride vehicle assembly being in a second interval of the track, different than the first interval.

22 Claims, 12 Drawing Sheets

(56) References Cited

U.S. PATENT DOCUMENTS

| | | | | |
|---|---|---|---|---|
| 12,415,406 | B2 * | 9/2025 | Maita | B61D 27/00 |
| 2011/0061558 | A1 | 3/2011 | Crawford et al. | |
| 2016/0023121 | A1 | 1/2016 | McVeen | |
| 2016/0045833 | A1 | 2/2016 | Boyle | |
| 2020/0108324 | A1 * | 4/2020 | Bloomfield | A63G 31/007 |
| 2020/0257309 | A1 | 8/2020 | White et al. | |
| 2020/0294401 | A1 | 9/2020 | Kerecsen | |
| 2021/0023463 | A1 | 1/2021 | Boyle | |
| 2022/0089202 | A1 | 3/2022 | Gorman et al. | |
| 2022/0281495 | A1 | 9/2022 | Green | |
| 2024/0189733 | A1 * | 6/2024 | Vance | A63G 25/00 |
| 2025/0026021 | A1 * | 1/2025 | Vance | A63G 31/00 |

* cited by examiner

RIDE VEHICLE DECOUPLING CONTROL SYSTEM AND METHOD

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Amusement parks and other entertainment venues have a variety of features to entertain guests. For example, an amusement park may include an attraction system such as a ride (e.g., a roller coaster, a train, etc.), a theatrical show, an extended reality system, and so forth. The attraction system may include a ride vehicle assembly that transports guests of the amusement park throughout or within the attraction system, such as along a track, performing various operations that entertain the guests. In conventional attraction systems, the individual ride vehicles of the ride vehicle assembly typically remain attached throughout the duration of the ride. Additionally or alternatively, a path of the ride vehicle assembly (e.g., along a track) may be predictable and consistent. These and other features may limit stimulation and excitement of the guest. Accordingly, it is now recognized that improved attraction systems are desired.

BRIEF DESCRIPTION

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, a ride system includes a track, a ride vehicle assembly, a coupling, and an actuation assembly. The ride vehicle assembly includes a first ride vehicle configured to move along the track and a second ride vehicle configured to move along the track. The coupling is configured to block a decoupling of the first ride vehicle from the second ride vehicle in response to the ride vehicle assembly being in a first interval of the track. The actuation assembly is configured to actuate the coupling to cause the decoupling of the first ride vehicle from the second ride vehicle in response to the ride vehicle assembly being in a second interval of the track, different than the first interval.

In an embodiment, a ride system includes a ride path, a ride vehicle assembly, a coupling, an actuation assembly, and a controller. The ride vehicle assembly includes a first ride vehicle configured to move along the ride path and a second ride vehicle configured to move along the ride path. The coupling is configured to block a decoupling of the first ride vehicle from the second ride vehicle. The actuation assembly is configured to actuate the coupling to cause the decoupling of the first ride vehicle from the second ride vehicle. The controller is configured to instruct the actuation assembly to actuate the coupling to cause the decoupling of the first ride vehicle from the second ride vehicle in response to a position characteristic of the ride vehicle assembly, a load characteristic of the ride vehicle assembly, or both.

In an embodiment, a method of operating a ride system includes blocking, via a coupling, a decoupling of a first ride vehicle from a second ride vehicle of a ride vehicle assembly. The method also includes determining, via a controller, a position of the ride vehicle assembly. The method also includes determining, via the controller, whether the position of the ride vehicle assembly meets a pre-defined relationship with a threshold position of the ride vehicle assembly. The method also includes controlling, via the controller and in response to determining that the position meets the pre-defined relationship with the threshold position, an actuation assembly corresponding to the coupling to cause the first ride vehicle to be decoupled from the second ride vehicle.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
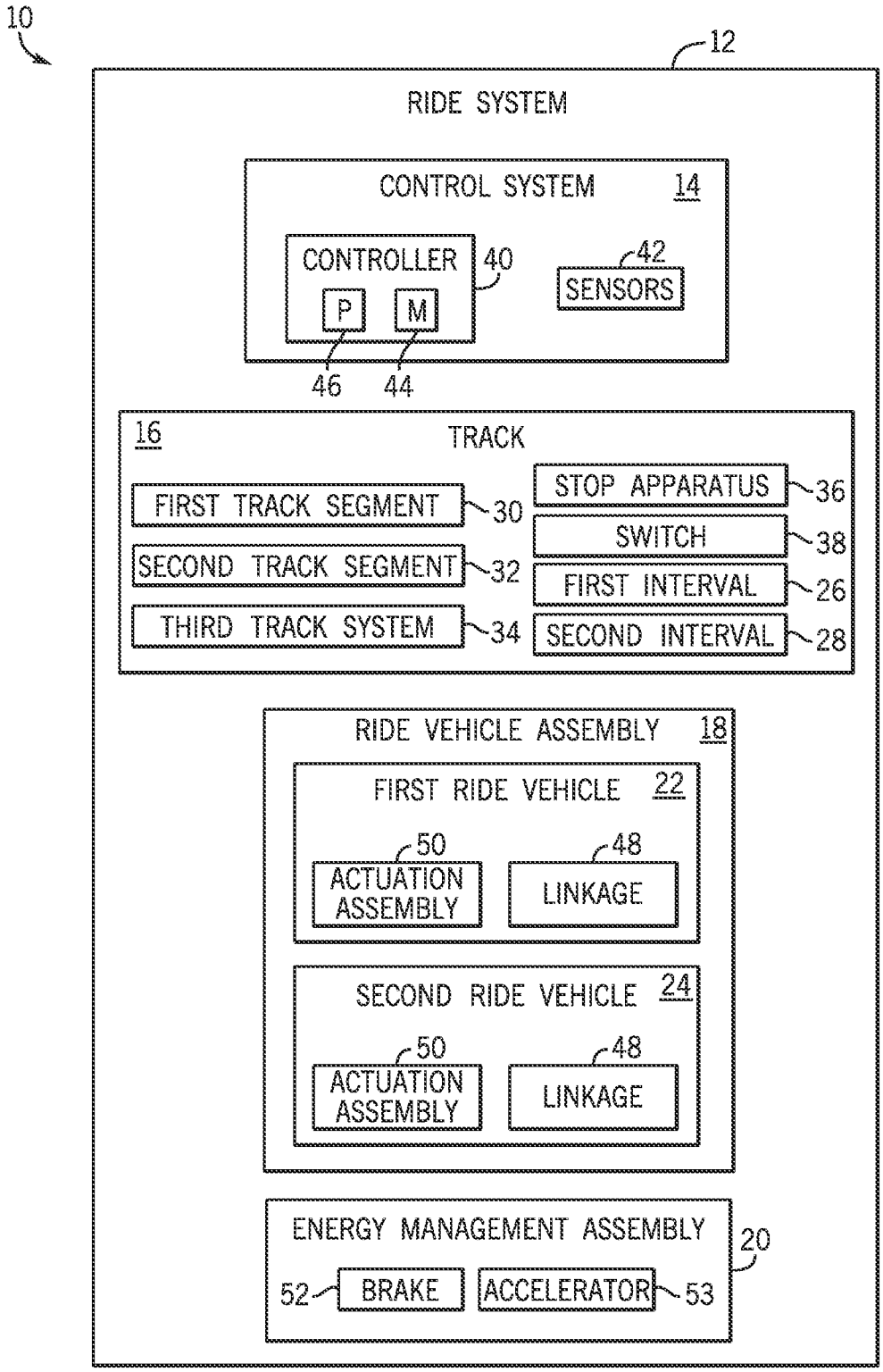
FIG. 1 is a block diagram of a ride system for an entertainment venue, in accordance with an aspect of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure is directed to a ride system of an entertainment venue. The ride system may include a ride vehicle assembly configured to move along a track of the ride system. The ride vehicle assembly may include more than one ride vehicle (e.g., two ride vehicles, three ride vehicles, etc.), with two or more separate ride vehicles coupled (wherein coupled comprises secured) via a coupling (e.g., mechanical coupling, magnetic coupling) between the two or more separate ride vehicles. For example, a first ride vehicle may include a first linkage that is coupled with a second linkage of a second ride vehicle via a rack and pinion. The coupling between the first ride vehicle and the second ride vehicle is configured to prevent a decoupling of the first ride vehicle from the second ride vehicle while the ride vehicle assembly is in a first interval of the track. In response to the ride vehicle assembly being in a second interval of the track, a controller may be employed to send a signal to an actuation assembly (or assemblies), which is configured to discontinue the coupling in response to receiving the signal, thereby decoupling the first ride vehicle from the second ride vehicle of the ride vehicle assembly. As described in detail with reference to the drawings, the coupling apparatus may include a mechanical coupling, a magnetic coupling, or any combination thereof.

In some embodiments, the controller may receive a signal from one or more sensors indicating a position characteristic corresponding to the ride vehicle assembly, a load characteristic corresponding to the ride vehicle assembly, or a combination thereof. In response to receiving the signal or signals, the controller may be configured to control the actuation assembly to decouple the first ride vehicle from the second ride vehicle. Additionally or alternatively, after the first and second ride vehicles are decoupled, the first and second ride vehicles may travel in different (e.g., opposing) directions and/or along different segments of the track. Further, in some embodiments, the ride vehicle assembly may include one or more pilot cars (e.g., cars including two axles each) positioned toward a middle of the ride vehicle assembly. For example, the above-described first ride vehicle may be a first pilot car, and the above-described second ride vehicle may be a second pilot car. Accordingly, upon decoupling of the first ride vehicle from the second ride vehicle, the first ride vehicle is supported by two axles and the second ride vehicle is supported by two axles. Thus, the coupling may be located between two consecutive pilot cars. Once the ride vehicles are decoupled, a switch disposed on the track may be employed to divert the ride vehicles to separate branches or segments of the track.

As described above, the ride system may include a coupling (e.g., mechanical coupling, magnetic coupling) used to couple and decouple two successive or adjacent ride vehicles. In some embodiments, the coupling may include two mechanical linkages which engage with each other. One linkage (e.g., corresponding to the first ride vehicle) may be a socket linkage and the other linkage (e.g., corresponding to the second ride vehicle) may be a ball linkage (e.g., where the ball is configured to fit in the socket). The linkages may be coupled or constrained using a locking apparatus (e.g., mechanism, magnetic system (e.g., magnets, electromagnetics, ferrous material), which may include a rack and a pinion coupled to the socket linkage. The locking apparatus is configured to couple the socket and ball linkages in response to the rack component of the locking apparatus being extended. In some embodiments, the locking apparatus (or componentry thereof) may be referred to as an actuator. That is, the locking apparatus (or componentry thereof) may be actuated to decouple the mechanical linkages, such as the socket linkage and the ball linkage. Other types of coupling and/or locking apparatuses, including those employing magnetic features, are also possible and will be described in detail with reference to the drawings.

The ride system may also include a stop apparatus disposed on the track, which is used to space and/or recouple the ride vehicles. The stop apparatus may be a mechanical device which is activated in response to a first ride vehicle passing the stop apparatus. Upon activation, the stop apparatus may actuate a stop plate, which blocks a forward motion of the second ride vehicle (and, in some embodiments, the first ride vehicle). The stop apparatus is placed such that the stopping location of the second ride vehicle enables a recoupling of the second ride vehicle with the first ride vehicle without causing damage to the associated linkages. The above-described features will be described in more detail below with reference to the drawings.

With the preceding in mind, FIG. 1 is a block diagram of an embodiment of a ride system 12 (e.g., for an entertainment venue). The ride system 12 includes a control system 14, a track 16, a ride vehicle assembly 18 (e.g., a train of ride vehicles), and an energy management assembly 20. The ride vehicle assembly 18 includes a first ride vehicle 22 configured to move along the track 16, and a second ride vehicle 24 configured to move along the track 16. However, it should be noted that the ride vehicle assembly 18 may include more than the two ride vehicles 22, 24 illustrated in FIG. 1, such as a third ride vehicle, a fourth ride vehicle, etc.

The track 16 includes a first interval 26 and a second interval 28. The first interval 26 may be a portion of the track 16 for which a load characteristic (e.g., mass moment of inertia, mass, force, torque, angular loading characteristics, etc.) of the ride vehicle assembly 18 does not meet a predefined relationship with a threshold load characteristic (e.g., threshold mass moment of inertia, threshold mass, threshold force, threshold torque, threshold angular loading characteristics, etc.). The second interval 28 may be a portion of the track 16 for which the load characteristic of the ride vehicle assembly 18 (or individual ride vehicles 22, 24 thereof) meets the predefined relationship with the threshold load characteristic. As described in detail below, the control system 14 may be configured to initiate a decoupling of the first ride vehicle 22 from the second ride vehicle 24 in response to the ride vehicle assembly 18 being in the second interval 28 of the track 16 (e.g., based on sensor feedback indicative of a position of the ride vehicle assembly 18).

In certain embodiments, decoupling of the first ride vehicle 22 from the second ride vehicle 24 may only be possible when the ride vehicle assembly 18 is in the second interval 28 of the track 16. For example, load characteristics (e.g., mass moment of inertia, mass, force, torque, angular loading characteristics, etc.) corresponding to the ride vehicle assembly 18 in the first interval 26 of the track 16 may be such that decoupling of the first ride vehicle 22 from the second ride vehicle 24 is not possible in the first interval 26 of the track 16. This may enable the first ride vehicle 22 and the second ride vehicle 24 to maintain a coupling (e.g., mechanical coupling, magnetic coupling) in response to an improper control signal received from the control system 24 (e.g., when the ride vehicle assembly 18 is not in the proper position for decoupling the first ride vehicle 22 from the second ride vehicle 24). In other embodiments, as described in detail below, one or more load characteristics may be detected and compared against one or more corresponding threshold load characteristics to determine whether decoupling is desired and/or possible (e.g., in addition to, or in the alternate of, position-based feedback).

In certain embodiments, the track 16 includes a first track segment 30, a second track segment 32 (e.g., connected to the first track segment 30), and a third track segment 34 (e.g., connected to the first track segment 30 and the second track segment 32). In this manner, the first track segment 30 and the second track segment 32 may form a first track configuration, and the first track segment 30 and the third track segment 34 may form a second track configuration. The above-described second interval 28 of the track 16 may reside within, or upstream of, the first track segment 30. Thus, the first ride vehicle 22 and the second ride vehicle 24 may be decoupled upstream of the second track segment 32 and the third track segment 34. Further, in certain embodiments, the track 16 may include a switch 35 for switching between the first track configuration and second track configuration of the track 16 (e.g., for diverting ride vehicles). That is, in the first track configuration, a ride vehicle (e.g., the first ride vehicle 22) may be forced from the first track segment 30 onto the second track segment 32, and in the second track configuration, a ride vehicle (e.g., the second ride vehicle 24) may be forced from the first track segment 30 onto the third track segment 34. The first track segment 30, second track segment 32, third track segment 34, and the corresponding track configurations are described in more detail below (e.g., with reference to later drawings).

The ride system 12 in FIG. 1 includes a stop apparatus 36 coupled to the track 16. In certain embodiments, the stop apparatus 36 may be considered a part of the track 16. The stop apparatus(s) 36 may be configured to stop and/or space consecutive ride vehicles to enable a recoupling of the ride vehicles (e.g., recoupling the first ride vehicle 22 with the second ride vehicle 23). The stop apparatus 36 is described in more detail below with reference to later drawings.

In the illustrated embodiment, the control system 14 includes a controller 40 configured to receive sensor data from sensor(s) 42 (e.g., position sensor, proximity sensor, laser or infrared sensor, load cell sensor, camera, etc.), and to control operation of the ride system 12 (e.g., based on the sensor data). The controller 40 includes a memory 44 and a processor 46 (e.g., processing circuitry, a microprocessor). Moreover, the processor 46 may include multiple microprocessors, one or more "general-purpose" microprocessors, one or more special-purpose microprocessors, and/or one or more application specific integrated circuits (ASICS), or some combination thereof. For example, the processor 46 may include one or more reduced instruction set (RISC) or complex instruction set (CISC) processors. The memory 44 may include a volatile memory, such as random access memory (RAM), and/or a nonvolatile memory, such as read-only memory (ROM). The memory 44 may store a variety of information and may be used for various purposes. For example, the memory 44 may store processor-executable instructions (e.g., firmware or software) for the processor 46 to execute, such as instructions for controlling various componentry of the ride system 12. The memory 44 and/or the processor 46, or an additional memory and/or processor, may be located in any suitable portion of the ride system 12.

As previously described, the sensors 42 may be configured to detect a position of the ride vehicle assembly 18 (e.g., relative to the track 16), load characteristics corresponding to the ride vehicle assembly 18, or both. The controller 40 may receive sensor feedback from the sensors 42 and initiate decoupling of the first ride vehicle 22 from the second ride vehicle 24 in response to the sensor feedback. As previously described, for example, the controller 42 may initiate decoupling of the first ride vehicle 22 from the second ride vehicle 24 in response to the ride vehicle assembly 18 being entirely or partially within the second interval 28 of the track 16. Additionally or alternatively, the controller 42 may initiate decoupling of the first ride vehicle 22 from the second ride vehicle 24 in response to one or more load characteristics (e.g., mass moment of inertia, mass, force, torque, angular loading characteristics) of the ride vehicle assembly 18 (or individual ride vehicles 22, 24 thereof) meeting a corresponding one or more threshold load characteristics (e.g., threshold mass moment of inertia, threshold mass, threshold force, threshold torque, threshold angular loading characteristics, etc.).

Various coupling apparatuses may be employed in various embodiments of the present disclosure. In one embodiment, the first ride vehicle 22, the second ride vehicle 24, or both may include one or more linkages 48 (e.g., mechanical linkages) and one or more actuation assemblies 50. A coupling between the linkage(s) 48 is configured to block a decoupling of the first ride vehicle 22 from the second ride vehicle 24 while the ride vehicle assembly 18 is on the first interval 26 of the track 16. The one or more actuation assemblies 50 are configured to actuate to discontinue the coupling between the linkages 48 (e.g., in response to a control signal from the controller 40) to decouple the first ride vehicle 22 from the second ride vehicle 24 when the ride vehicle assembly 18 is on the second interval 28 of the track 16. In some embodiments, as described with reference to later drawings, the first ride vehicle 22 may include the actuation assembly 50, while the second ride vehicle 24 does not include an actuation assembly. Further, the coupling apparatus may include strictly mechanical coupling features, strictly magnetic coupling features, a combination of mechanical and magnetic coupling features, and the like. In some embodiments, the coupling apparatuses may include solely magnetic coupling(s) between successive ride vehicles via magnets. For example, the first ride vehicle 22 may include a first magnet configured to couple to a second magnet of the second ride vehicle 24. These embodiments are described in more detail in regards to FIGS. 7 and 8.

The ride system 12 also includes an energy management assembly 20. In certain embodiments, the energy management assembly 20 includes at least one brake 52 (e.g., motor (e.g., linear induction motor, linear synchronous motor), drive wheels, friction brakes) and/or at least one accelerator 53 (e.g., motor (e.g., linear induction motor, linear synchronous motor), drive wheels, chain-drive, hydraulic acceleration system). The energy management assembly 20 may be configured to accelerate the ride vehicles 22, 24 relative to each other. For example, the energy management assembly 20 may be configured to speed up (e.g., via the accelerator 53) the first ride vehicle 22, slow down the second ride vehicle 24 (e.g., via the brake 52, via the accelerator 53), or both. In an embodiment, the brake 52 and the accelerator 53 may be the same (e.g., linear induction motor, linear synchronous motor, drive wheels). Acceleration, as described above, may be employed to generate a gap between the first ride vehicle 22 and the second ride vehicle 24 following a decoupling of the first ride vehicle 22 and the second ride vehicle 24, or to reduce a gap between the first ride vehicle 22 and the second ride vehicle 24 to enable a recoupling of the first ride vehicle 22 and the second ride vehicle 24. Further, in some embodiments, acceleration may be employed immediately before and/or during decoupling of the first ride vehicle 22 from the second ride vehicle 24. In some embodiments, acceleration may be employed immediately before and/or during coupling and/or recoupling of the first ride vehicle 22 to the second ride vehicle 24.

Figure 2:
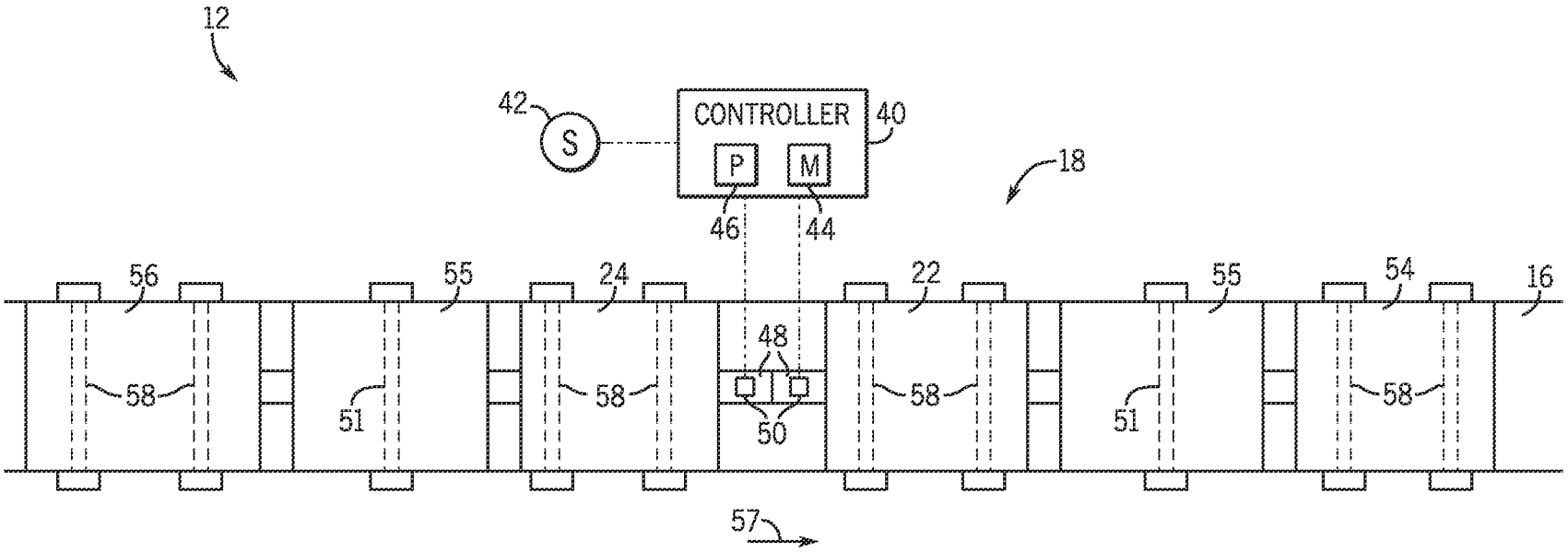
FIG. 2 is a top view of the ride system of FIG. 1, including a ride vehicle assembly with various ride vehicles configured to be coupled and decoupled during various intervals of the ride system, in accordance with an aspect of the present disclosure.

FIG. 2 is a top view of an embodiment of the ride system 12 of FIG. 1. In the illustrated embodiment, the ride vehicle assembly 18 includes the first ride vehicle 22, the second ride vehicle 24, a third ride vehicle 54, and a fourth ride vehicle 56. The third ride vehicle 54 is connected to the first ride vehicle 22 (e.g., indirectly via intermediate ride vehicle(s) 55), such that the first ride vehicle 22 is between the second ride vehicle 24 and the third ride vehicle 54. The fourth ride vehicle 56 is connected to the second ride vehicle 24 (e.g., indirectly via intermediate ride vehicle(s) 55), such that the second ride vehicle 24 is between the first ride vehicle 22 and the fourth ride vehicle 56. While all four ride vehicles 22, 24, 54, 56 are connected (e.g., belonging to the same ride vehicle assembly), the ride vehicle assembly 18 may move in a common direction of travel 57.

The first ride vehicle 22 may include two axles 58. In certain embodiments, the second ride vehicle 24 also includes two axles 58. In this way, the first ride vehicle 22 and the second ride vehicle 24 may each be referred to as a "pilot car." In certain traditional embodiments, only a front and back vehicle in an assembly of interconnected vehicles would include two axles and, thus, be referred to as pilot cars. However, as described in detail below, because the first ride vehicle 22 and the second ride vehicle 24 in the illustrated embodiment may be periodically decoupled and recoupled, the first ride vehicle 22 and the second ride vehicle 24 may both include two axles 58 such that loads of the first ride vehicle 22 and the second ride vehicle 24 are properly balanced upon decoupling of the first ride vehicle 22 from the second ride vehicle 24. In other words, the first ride vehicle 22 and the second ride vehicle 24 may include two axles 58 in order to support different load characteristics that arise when the ride vehicles 22, 24 are coupled and when the ride vehicles 22, 24 are decoupled. In certain embodiments, the third ride vehicle 54 (e.g., and additional ride vehicles after the third ride vehicle 54) and the fourth ride vehicle 56 (e.g., and additional ride vehicles after the fourth ride vehicle 56) may each include two axles 58. In this way, the third ride vehicle 54 and the fourth ride vehicle 56 may also be referred to as pilot cars.

In certain embodiments, intermediary ride vehicle(s) 55 may be placed between the first ride vehicle 22 and the third ride vehicle 54, as well as between the second ride vehicle 24 and the fourth ride vehicle 56. In certain embodiments, ride vehicle(s) 55 may include a single axis 51 per ride vehicle and, in certain embodiments, two axes. It should be understood by the reader that the preceding description regarding intermediary ride vehicle(s) 55 may apply to any subsequent description regarding ride vehicles 22, 24, 54, and 56.

In the illustrated embodiment, the ride system 12 includes the controller 40. The controller 40 is communicatively coupled to the sensor(s) 42 (e.g., proximity, laser, load cell, camera, etc.) and one or more actuation assemblies 50 via wired connection(s) (e.g., Common Industrial Protocol (CIP), Ethernet or Local Area Network (LAN), CAN, etc.) and/or wireless connection(s) (e.g., Bluetooth, WiFi, etc.). The controller 40 is configured to receive an indication (e.g., signal) of a position characteristic (e.g., position of ride vehicle assembly), a measured load characteristic (e.g., mass moment of inertia, mass, force, torque, etc.), or both, corresponding to the ride vehicle assembly 18 via the sensor(s) 42 (e.g., proximity, laser, load cell, camera, etc.). The controller 40 is configured to control the one or more actuation assemblies 50 based on the position characteristic, load characteristic (e.g., measured load characteristic), or both. For example, the controller 40 may instruct the one or more actuation assemblies 50 to decouple the linkages 48 between the first ride vehicle 22 and the second ride vehicle 24, such that the first ride vehicle 22 is decoupled from the second ride vehicle 24. It should be noted that certain embodiments may not employ sensor feedback directed toward load characteristics.

Figure 3:
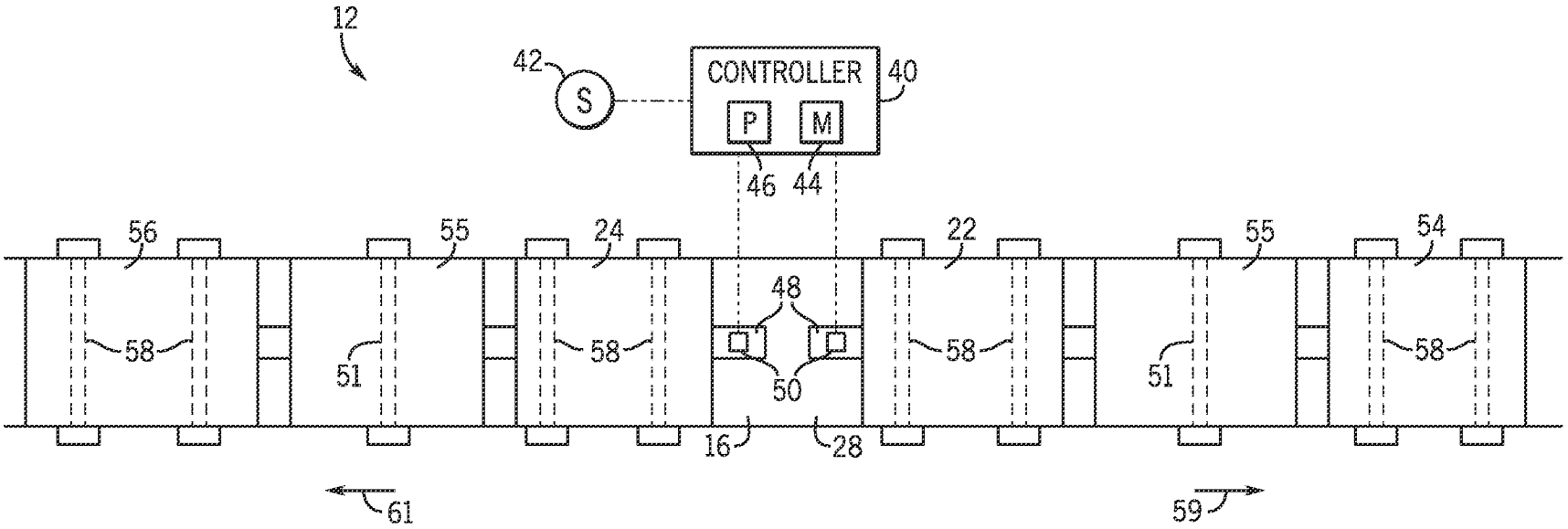
FIG. 3 is a top view of the ride system of FIG. 1, including a ride vehicle assembly having a first ride vehicle decoupled from a second ride vehicle, in accordance with an aspect of the present disclosure.

FIG. 3 is a top view of an embodiment of the ride system 12 of FIG. 1, including the ride vehicle assembly 18 having the first ride vehicle 22 decoupled from the second ride vehicle 24. In the illustrated embodiment, the ride system 12 includes the controller 40. The controller 40 is communicatively coupled to sensor(s) 42 (e.g., proximity, laser, load cell, camera, etc.) and one or more actuation assemblies 50 via wired connection(s) (e.g., CIP, Ethernet or LAN, CAN, etc.) and/or wireless connection(s) (e.g., Bluetooth, WiFi, etc.). The controller 40 may be configured to receive an indication (e.g., signal) of a position characteristic (e.g., position of ride vehicle assembly), load characteristic (e.g., mass moment of inertia, mass, force, torque, etc.), or both, corresponding to the ride vehicle assembly 18 via the sensor(s) 42 (e.g., proximity, laser, load cell, camera, etc.).

Further, the controller 40 may be configured to control the one or more actuation assemblies 50 based on the signal, as previously described.

In the illustrated embodiment, the one or more actuation assemblies 50 are configured to be actuated to discontinue the coupling between the linkages(s) 48, thereby decoupling the first ride vehicle 22 from the second ride vehicle 24 when the ride vehicle assembly 18 (e.g., both first and second ride vehicles) is in the second interval 28 of the track 16. Upon the decoupling of the first ride vehicle 22 from the second ride vehicle 24, the first ride vehicle 22 may be directed in a direction of travel 59 along the track 16 and the second ride vehicle 24 may be directed in a direction of travel 61 along the track 16. As shown, the direction of travel 59 may be transverse to (e.g., oppose) the direction of travel 61.

In certain embodiments, upon decoupling of the first ride vehicle 22 from the second ride vehicle 24, the first ride vehicle 22 may be directed in the direction of travel 59 along the track 16 and the second ride vehicle 24 may be directed in the direction of travel 61 along the track 16. In some embodiments, the direction of travel 59 may be in a direction different than the direction of travel 61.

In certain embodiments, upon decoupling of the first ride vehicle 22 from the second ride vehicle 24, both ride vehicles 22, 24 are directed onto the same track segment (e.g., both ride vehicles travel in the same direction of travel). For example, the first ride vehicle 22 may decouple from the second ride vehicle 24, causing the first ride vehicle 22 to accelerate along the track 16 while the second ride vehicle 24 moves at a lower velocity and/or acceleration. Sometime later, the second ride vehicle 24 may move along the track 16 in the same direction of travel.

In certain embodiments, there may be more than one interval of the track 16 (e.g., more than one second interval 28) for which the controller 40 is configured to instruct decoupling of the ride vehicle assembly 18 (e.g., two intervals, three intervals, etc.). In certain embodiments, the ride vehicle assembly 18 may decouple more than once (e.g., decouple twice, decouple thrice, etc.) such that there may be more than two separate ride vehicles (e.g., three ride vehicles, four ride vehicles, etc.). In certain embodiments, the ride vehicle assembly 18 may decouple at a single time instant (e.g., into two or more separate ride vehicles), while in other embodiments the ride vehicle assembly 18 may decouple at multiple time instants throughout a ride sequence.

In certain embodiments, the controller 40 may be configured to instruct variation of how the ride vehicle assembly 18 is decoupled between ride sequences (e.g., location of decoupling, order of decoupling, etc.). The variation of decoupling(s) may follow a repetitive pattern or be decided randomly or pseudo-randomly. In response to deciding the order in which the ride vehicles decouple, the controller 40 may be configured to update factors to account for the change in dynamics. Such factors may comprise the location of second interval 28 on the track 16 at which the ride vehicle assembly 18 decouples, enabling or disabling switch(s) 38 to open/close corresponding track segment(s), etc.

Figure 4:
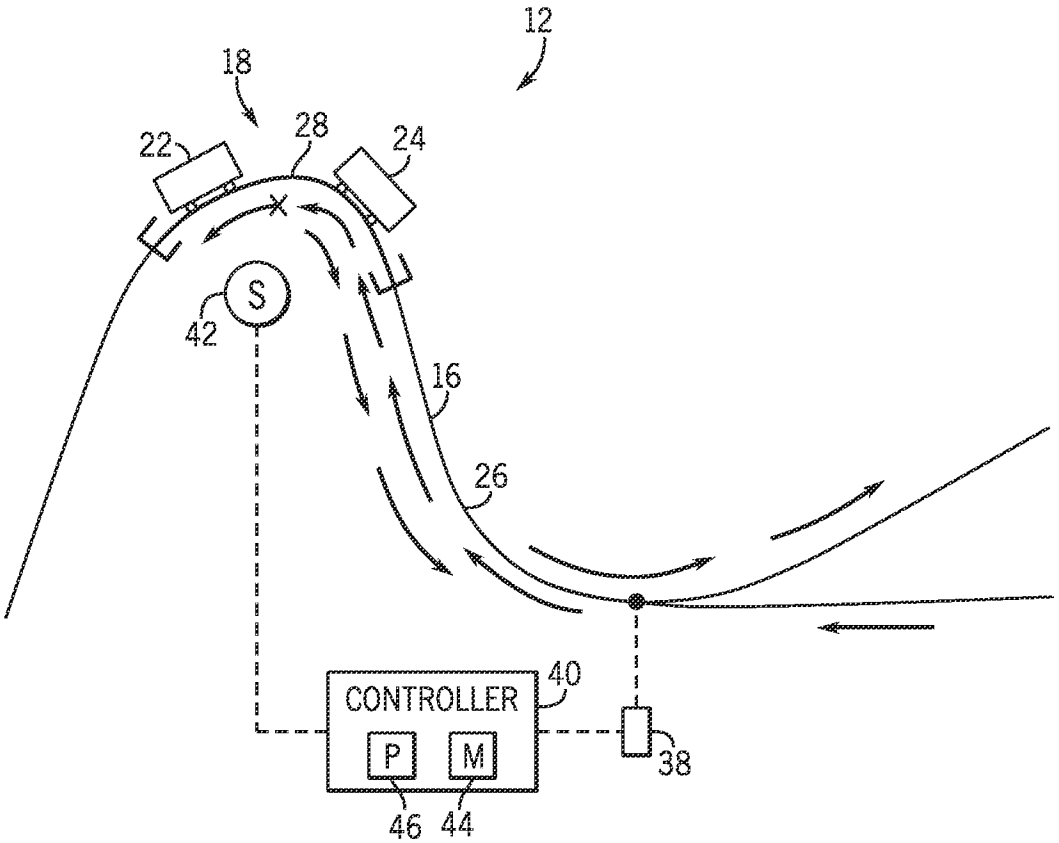
FIG. 4 is a side view of the ride system of FIG. 1, including a ride vehicle assembly having a first ride vehicle decoupled from a second ride vehicle in response to meeting a pre-defined relationship with a threshold load characteristic, actuation of an engagement assembly, or both, in accordance with an aspect of the present disclosure.

FIG. 4 is a side view of an embodiment of the ride system 12 of FIG. 1, including the ride vehicle assembly 18 separating into a first assembly (e.g., including first ride vehicle 22) and a second assembly (e.g., including the second ride vehicle 24) in response to a control signal and/or the ride vehicle assembly 18 meeting a pre-defined relationship with a threshold load characteristic (e.g., mass moment of inertia, mass, force, torque, etc.). The illustrated embodiment shows the first ride vehicle 22 decoupled from the second ride vehicle 24 (e.g., via the one or more actuation assemblies actuating the coupling[s]) in response to the current position of the ride vehicle assembly 18 meeting a predefined position characteristic. Data from sensor(s) 42 (e.g., laser, proximity, ultrasonic, camera, etc.) may be used to determine when the ride vehicle assembly 18 is located at a certain position along the track 16, thereby meeting the predefined position characteristic. In this manner, the one or more actuation assemblies 50 are configured to actuate linkages 48 (e.g., via receiving a signal from the controller 40) when the ride vehicle assembly 18 meets the predefined position characteristic. In some embodiments, the first ride vehicle 22 may be decoupled from the second ride vehicle 24 in response to the current position of the ride vehicle assembly 18 meeting a predefined position characteristic, a load characteristic (e.g., mass moment of inertia, mass, force, torque, angular loading characteristics, etc.) of the ride vehicle assembly 18 meeting a predefined relationship with a threshold load characteristic (e.g., threshold mass moment of inertia, threshold mass, threshold force, threshold torque, threshold angular loading characteristics, etc.), or a combination thereof.

In the illustrated embodiment, the position of the ride vehicle assembly 18 along the track 16 meets the predefined position characteristic when the ride vehicle assembly 18 is in the second interval 28 of the track 16 (e.g., at the top of a hill formed by track 16). The ride system 12 is configured such that the load characteristic of the ride system 12 does not meet the threshold characteristic while the ride vehicle assembly 18 is in the first interval 26 of the track 16. In this way, decoupling of the first ride vehicle 22 and the second ride vehicle 24 may be blocked while the ride vehicle assembly 18 is in the first interval 26 of the track 16. Additionally or alternatively, in certain embodiments, data from sensor(s) 42 may be used to monitor a measured load characteristic of the ride vehicle assembly 18 at all times during the ride sequence, based on a position of the ride vehicle assembly 18, or both.

In certain embodiments, the second interval 28 of the track 16 that enables the ride vehicle assembly 18 to meet the required load characteristic (e.g., mass moment of inertia, mass, force, torque, etc.) needed for decoupling may include the peak of a hill, a curve, a flat portion of the track 16, or a valley in the track 16. In certain embodiments, decoupling of the first ride vehicle 22 from the second ride vehicle 24 may be assisted by a gravity force of the first ride vehicle 22 and/or the second ride vehicle 24. In other embodiments, the first ride vehicle 22 may decouple from the second ride vehicle 24, followed by the two ride vehicles being actively propelled (e.g., mechanically propelled (e.g., with drive wheels), hydraulically propelled, magnetically propelled (e.g., with linear induction motor, with linear synchronous motor) in opposite directions.

In certain embodiments, data from a combination of sensors 42 may be used to determine the location of the ride vehicle assembly 18 before a decoupling of the two ride vehicles. For example, load cell(s) may be disposed along the track 16 to detect the presence of the ride vehicle assembly 18 at a particular location along the track 16. In another embodiment, an optical sensor (e.g., proximity sensor, laser sensor, camera, etc.) may be disposed along (e.g., beneath, on the side of) the track 16 to detect the presence of the ride vehicle assembly 18 at a particular location along the track. In certain embodiments, data from a combination of the aforementioned types of sensors may be used to detect the presence of the ride vehicle assembly 18 prior to decoupling.

In certain embodiments, electromagnets and/or permanent magnets disposed along (e.g., beneath, on the side of, extending upward from, extending downward from) the track 16 may be used to adjust the position of the ride vehicle assembly 18 (e.g., with affixed magnets) prior to decoupling the ride vehicle assembly 18 into separate ride vehicles. For example, data from sensor(s) 42 may be used to detect that the ride vehicle assembly 18 is in the general vicinity of the second interval 28 of the track 16. In response to the sensor(s) 42 detecting that the ride vehicle assembly 18 is in a general vicinity of the second interval 28 of the track 16, electromagnets and/or permanent magnets may be used to adjust the position of the ride vehicle assembly 18 to a more precise position for decoupling (e.g. under instruction by the controller 40).

In certain embodiments, data from force sensor(s) (e.g., load cell sensors, pneumatic load cell sensors, capacitive load cell sensors, strain gauges, force sensing resistors), may be used in addition to data from a position sensor to determine when the ride vehicle assembly 18 is present within the second interval 28 of the track 16 (and/or to determine load characteristics of the ride vehicle assembly 18). The force sensor(s) may be configured to detect a load exerted by the ride vehicle assembly 18. In certain embodiments, the ride vehicle assembly 18 may be configured to decouple in response to both position sensor(s) and force sensor(s) detecting the presence of the ride vehicle assembly 18 within the second interval 28 of the track 16.

Figure 5:
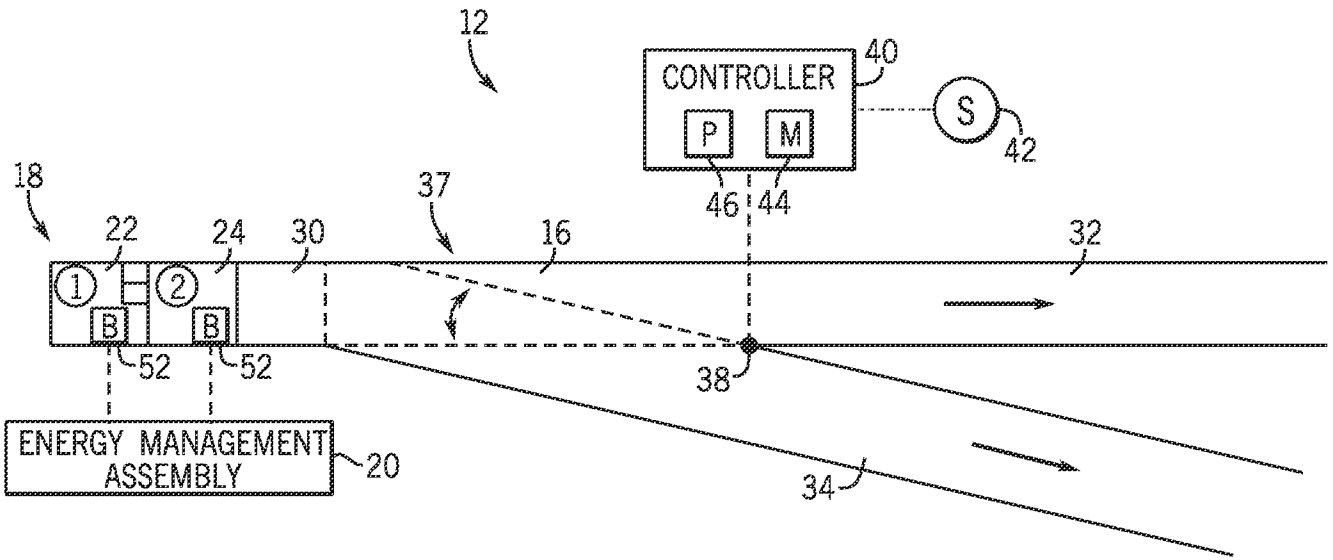
FIG. 5 is a top view of the ride system of FIG. 1, in which a first ride vehicle is directed from a first track segment onto a second track segment, and a second ride vehicle is directed from the first track segment onto a third track segment, in accordance with an aspect of the present disclosure.

FIG. 5 is a top view of an embodiment of the ride system 12 of FIG. 1, including features configured to direct the first ride vehicle 22 from the first track segment 30 onto the second track segment 32 and the second ride vehicle 24 from the first track segment 30 onto the third track segment 34. In the illustrated embodiment, the track 16 includes the second track segment 32 connected to the first track segment 30. The third track segment 34 is also connected to the first track segment 30 (e.g., first track segment splits into the second and third track segments).

The track 16 may also include the switch 35 configured to change the track 16 between a first track configuration and a second track configuration. The first track configuration is configured to direct the first ride vehicle 22 from the first track segment 30 onto the second track segment 32 (e.g., branch track). The second track configuration is configured to direct the second ride vehicle 24 from the first track segment 30 onto the third track segment 34 (e.g., branch track).

In the illustrated embodiment, the controller 40 instructs the switch 35 to actuate from the first track configuration to the second track configuration. The switch 35 may be actuated after the first ride vehicle 22 is directed from the first track segment 30 onto the second track segment 32, and when the juncture 37 (e.g., between the first track segment 30 and second track segment 32) is positioned within the gap (e.g., generated by the energy management assembly 20) between the first ride vehicle 22 and the second ride vehicle 24. The switch 35 may comprise its own circuitry for receiving signal(s) from the controller 40, and also an actuator (e.g., electric, magnetic, mechanical, hydraulic, pneumatic) used for switching (e.g., moving a portion of the rail of the track 16) between the two track segments.

In certain embodiments, more than one switch 35 (e.g., two switches, three switches, etc.) may be used at one or more junctures of the track 16 (e.g., two junctures, three junctures, etc.). In certain embodiments, the switch 35 may be configured to direct more than two ride vehicles (e.g., three ride vehicles, four ride vehicles, etc.) from the first track segment 30 to two or more track segments (e.g., three track segments, four track segments, etc.). For example, the first ride vehicle 22 may be diverted to the second track segment 32, the second ride vehicle 24 may be directed to the third track segment 34, and a third ride vehicle may be directed to a fourth track segment. The diversions may take place at a single juncture of the track 16 or at multiple junctures.

In certain embodiments, the track 16 may include the second track segment 32 connected to the first track segment 30. The third track segment 34 may also be connected to the first track segment 30 (e.g., second and third track segments merge into the first track segment). With this track configuration, the ride system 12 may direct the first ride vehicle 22 from the second track segment 32 onto the first track segment 30, and the second ride vehicle 24 from the third track segment onto the first track segment 30.

As explained previously, the track 16 also may include the switch 35 configured to change the track 16 between a first track configuration and a second track configuration. The first track configuration may be configured to direct the first ride vehicle 22 from the second track segment 32 (e.g., branch track) onto the first track segment 30 (e.g., main track). The second track configuration may be configured to direct the second ride vehicle 24 from the third track segment 34 onto the first track segment 30 (e.g., main track).

In certain embodiments, the switch 35 may be configured to direct more than two ride vehicles (e.g., three ride vehicles, four ride vehicles, etc.) from two or more two track segments (e.g., three track segments, four track segments, etc.) to the first track segment 30. In certain embodiments, there may be more than one merge junctures disposed along the track 16 (e.g., two merge juncture, three merge junctures, etc.).

In certain embodiments, sensor(s) 42 (e.g., load cell, pneumatic load cell, capacitive load cell, strain gauge, force sensing resistor, proximity, laser, camera, etc.) may be disposed along the first track segment 30, the second track segment 32, and/or the third track segment 34 to detect a successful divergence and/or merging of the ride vehicles. For example, the controller 40 may be configured to expect a detection of the ride vehicles (e.g., after diverging onto separate branch tracks) via sensor(s) 42 disposed along the branch tracks at a given time duration after detecting the combined ride vehicle assembly 18 via sensor(s) 42 disposed on the main track. In some embodiments, a radio frequency identification (RFID) tag may be disposed on each ride vehicle (e.g., first and second ride vehicles 22, 24) of the ride vehicle assembly 18 such that each ride vehicle is uniquely identified. One or more RFID readers, disposed along various locations of the track 16, may then be used to detect and/or identify each ride vehicle, and the controller 40 may use data from the RFID readers to thereby determine successful divergence and/or merging of ride vehicles.

Figure 6:
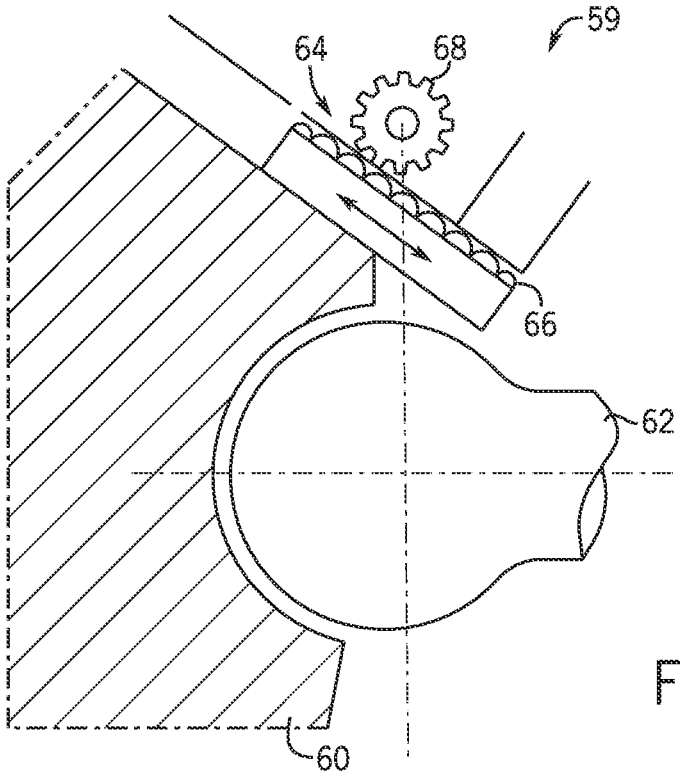
FIG. 6 is a side view of a coupling (e.g., mechanical coupling) used for coupling and decoupling a first ride vehicle and a second ride vehicle of a ride vehicle assembly corresponding to the ride system of FIG. 1, in accordance with an aspect of the present disclosure.

FIG. 6 is a schematic illustration of an embodiment of a mechanical coupling 59 used for coupling and decoupling the first ride vehicle 22 of FIG. 1 and the second ride vehicle 24 of FIG. 1. Other types of coupling apparatuses are also possible and will be described in detail with reference to later drawings. The mechanical coupling 59 in FIG. 6 is between a first linkage 60 (e.g., corresponding to the linkage 48 of the first ride vehicle 22 in FIG. 1) and a second linkage 62 (e.g., corresponding to the linkage 48 of the second ride vehicle 24 in FIG. 1) configured to engage with the first linkage 60. The mechanical coupling 59 also includes a locking apparatus 64 (e.g., mechanism, magnetic system (e.g., magnets, electromagnetics, ferrous material)), which in certain embodiments includes a rack 66 and a pinion 68. The locking apparatus 64 (or componentry thereof) may be referred to in certain instances of the present disclosure as an actuator. The locking apparatus 64 is configured to couple the first linkage 60 to the second linkage 62 when the rack 66 is extended (e.g., via the pinion 68). The locking apparatus 64 is also configured to disengage the first linkage 60 from the second linkage 62 when the rack 66 is retracted (e.g., via the pinion 68). In the illustrated embodiment, the first linkage 60 (e.g., corresponding to the first ride vehicle) is a socket linkage and the second linkage 62 (e.g., corresponding to the second ride vehicle) is a ball linkage (e.g., where the ball is configured to fit in the socket). It may be appreciated that the ball and socket design of the mechanical coupling 59 may enable the first ride vehicle 22 to pivot relative to the second ride vehicle 24.

In certain embodiments, more than one mechanical coupling 59 may be used between successive ride vehicles (e.g., two mechanical couplings, three mechanical couplings, etc.). In certain embodiments, redundant locking apparatuses 64 may be used to couple the two linkages together (e.g., two locking apparatuses, three locking apparatuses, etc.). In certain embodiments, one or more separate carts may be used to block the first linkage 60 and/or the second linkage 62 from making contact with the track after the linkages are decoupled. In certain embodiments, another form of actuation for moving the rack 66 to cover the ball linkage may be used (e.g., magnetic, electric, hydraulic, pneumatic).

In certain embodiments, the mechanical coupling 59 may be used in conjunction with magnetic coupling(s) (e.g., permanent magnet couplings, electromagnetic couplings, ferrous material couplings), which couple successive ride vehicles via permanent magnets and/or ferrous material and/or electromagnets. In certain embodiments, the decoupling of successive ride vehicles may take place in stages. For example, the first stage may be the decoupling of the mechanical coupling 59. The second stage may be the decoupling of the magnetic coupling(s). It may be appreciated that by using multiple types of couplings, the added redundancy adds for a safer connection, and may allow for easier decoupling of the mechanical coupling 59 (e.g., required to overcome a lower friction force). The controller may be configured to send a signal, for example, to the locking apparatus 64 to cause the locking apparatus 64 to actuate (e.g., retracting the rack 66) such that the mechanical coupling 59 between the first linkage 60 and the second linkage 62 is discontinued In certain embodiments, one or more sensors (e.g., load cell, pneumatic load cell, capacitive load cell, strain gauge, force sensing resistor, proximity, laser, camera, etc.) may be disposed on the first linkage 60, the second linkage 62, or both. The sensors may be configured to send a signal to the controller in response to the linkages 60, 62 being in a condition for coupling. In certain embodiments, in response to receiving the signal from the sensors, the controller may be configured to instruct actuation of the locking apparatus 64 to couple the first linkage 60 to the second linkage 62. In response to the locking apparatus 64 coupling the two linkages, the sensor(s) may also be configured to send a signal to the controller indicating a successful coupling and/or decoupling of linkages.

In certain embodiments, one or more sensors (e.g., load cell, pneumatic load cell, capacitive load cell, strain gauge, force sensing resistor, proximity, laser, camera, etc.) may be disposed on the first linkage 60, the second linkage 62, or both, such that the controller is configured to instruct detection, via the sensors, of a coupling of the first linkage 60 to the second linkage 62 via the locking apparatus 64. For example, the controller may be configured to determine that the rack 66 is extended a threshold distance. In response to determining that all of the linkages are coupled, the controller may be configured to instruct continuation with the ride sequence. In response to determining that at least one of the linkages is not coupled via the rack 66 and pinion 68, the controller may be configured to output an alert and/or instruct a prevention of the ride sequence from continuing.

In certain embodiments, the mechanical coupling 59 may be designed such that either end (e.g., the front end and back end) of the first ride vehicle may be able to connect with either end (e.g., the front end and the back end) of the second ride vehicle. In this manner, the first ride vehicle and/or the second ride vehicle may be able to change orientations during the ride (e.g., whether the front end precedes the back end or vice versa), while still being able to connect with other ride vehicles.

In certain embodiments, the first linkage 60 of the mechanical coupling 59 is identical (e.g., identical in shape, functionality, etc.) to the second linkage 62 of the mechanical coupling 59, such that any two linkages of any two ride vehicles may be connected, regardless of whether the front end or back end of each ride vehicle is connected. In certain embodiments, an interlocking asexual coupling may be used to connect the one or more ride vehicles. The interlocking asexual coupling may be designed such that both linkages of the asexual coupling for each corresponding ride vehicle are identical.

In certain embodiments, a spring-loaded, automatic coupler (e.g., Schaku coupling, Schwab coupling, etc.) may be used for improved coupling and decoupling of ride vehicles. By using an automatic coupler, two ride vehicles may be coupled via a spring-loaded component coupling the first linkage 60 and the second linkage 62 in response to the linkages being pressed against one another. In certain embodiments, the entire mechanical coupling 59 may act as a spring-damper system (e.g., via a spring, hydraulics), so as to prevent a sudden jerk during coupling and decoupling. In certain embodiments, buffers (e.g., spring-loaded, hydraulic) may be coupled to the front end and/or back end of the ride vehicles. When the ride vehicles are recoupled, the buffers may absorb a portion of the impact force so as to reduce a jerking motion induced on the passengers.

Figure 7:
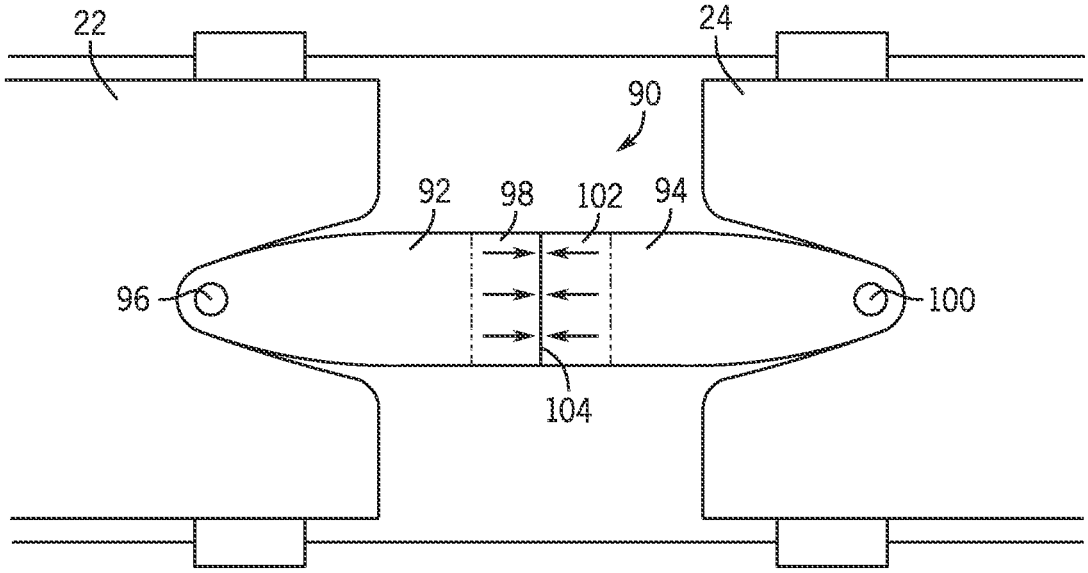
FIG. 7 is a top view of a coupling (e.g., magnetic coupling) used for coupling and decoupling a first ride vehicle and a second ride vehicle of a ride vehicle assembly corresponding to the ride system of FIG. 1, in accordance with an aspect of the present disclosure.

FIG. 7 is a top view of an embodiment of a magnetic coupling 90 (e.g., permanent magnet couplings, electromagnetic couplings, ferrous material couplings) used for coupling and decoupling the first ride vehicle 22 of FIG. 1 and the second ride vehicle 24 of FIG. 1. The magnetic coupling 90 may include a first linkage 92 (e.g., corresponding to the linkage 48 of the first ride vehicle 22 in FIG. 1) and a second linkage 94 (e.g., corresponding to the linkage 48 of the first ride vehicle 22 in FIG. 1). The first linkage 92 is may be rotatably coupled to the first ride vehicle 22 via a pivot 96, and includes a magnet 98 (e.g., electromagnet). The second linkage 94 may be rotatably coupled to the second ride vehicle 24 via a pivot 100, and may include a magnet 102 (e.g., electromagnet). The magnet 98 of the first linkage 92 may attract the magnet 102 of the second linkage 94 (e.g., of opposite polarity), thereby enabling a coupling of the two linkages at the interface 104. A controller may ensure (e.g., instruct) that the polarity of the magnet 98 is opposite the polarity of the magnet 102. It may be appreciated that the illustrated embodiment of magnetic coupling 90 may also be considered an asexual coupling, due to the first linkage 92 and the second linkage 94 being identical. Further, while the electromagnet features of the magnets 98, 102 are described in certain instances of the present disclosure, permanent magnetic features and ferrous features (e.g., iron features, steel features) may also be employed.

In the illustrated embodiment, the first ride vehicle 22 may pivot relative to the second ride vehicle 24 via pivots 96 and 100, while also enabling the magnets 98, 102 to couple at the interface 104, so as to remove any relative motion (e.g., friction) between the two electromagnets. It may be appreciated that the first linkage 92 and second linkage 94 may be identical in shape, thereby allowing any ride vehicle to couple to either side of any other ride vehicle.

Figure 8:
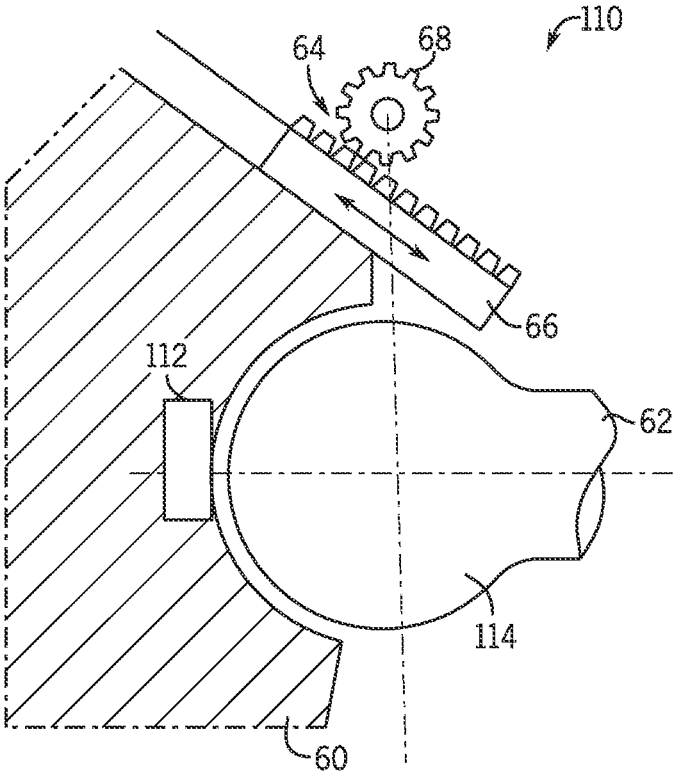
FIG. 8 is a side view of a coupling (e.g., combined magnetic and mechanical coupling) used for coupling and decoupling a first ride vehicle and a second ride vehicle of a ride vehicle assembly corresponding to the ride system of FIG. 1, in accordance with an aspect of the present disclosure.

FIG. 8 is a side view of another embodiment of a coupling 110 (e.g., combined mechanical and magnetic coupling) used for coupling and decoupling the first ride vehicle 22 of FIG. 1 and the second ride vehicle 24 of FIG. 1. As with the coupling 59 shown in FIG. 6, the coupling 110 in FIG. 8 may also include the first linkage 60 (e.g., corresponding to the linkage 48 of the first ride vehicle 22 in FIG. 1) and the second linkage 62 (e.g., corresponding to the linkage 48 of the second ride vehicle 24 in FIG. 1) configured to engage with the first linkage 60. The coupling 110 may also include the locking apparatus 64 (e.g., mechanism, magnetic system (e.g., magnets, electromagnetics, ferrous material), which in certain embodiments may include the rack 66 and the pinion 68. The coupling 59 may also include magnet 112 (e.g., electromagnet) disposed in the first linkage 60 and magnet 114 (e.g., electromagnet) disposed in the second linkage 62. The magnets 112 and 114 may be of opposite polarity, so as to attract each other. Further, while the electromagnet features of the magnets 112, 114 are described in certain instances of the present disclosure, permanent magnetic features and ferrous features (e.g., iron features, steel features) may also be employed. In certain embodiments, the second linkage 62 may be composed of a ferrous metal (e.g., iron, steel) and may be attracted to the first linkage 60 by the magnet 112. In other embodiments, the first linkage 60 may be composed of a ferrous metal and may be attracted to the second linkage 62 by the magnet 114. The coupling 59 may be similar to, or the same as, the ball-and-socket configuration of the coupling 59 illustrated in FIG. 6.

Figure 9:
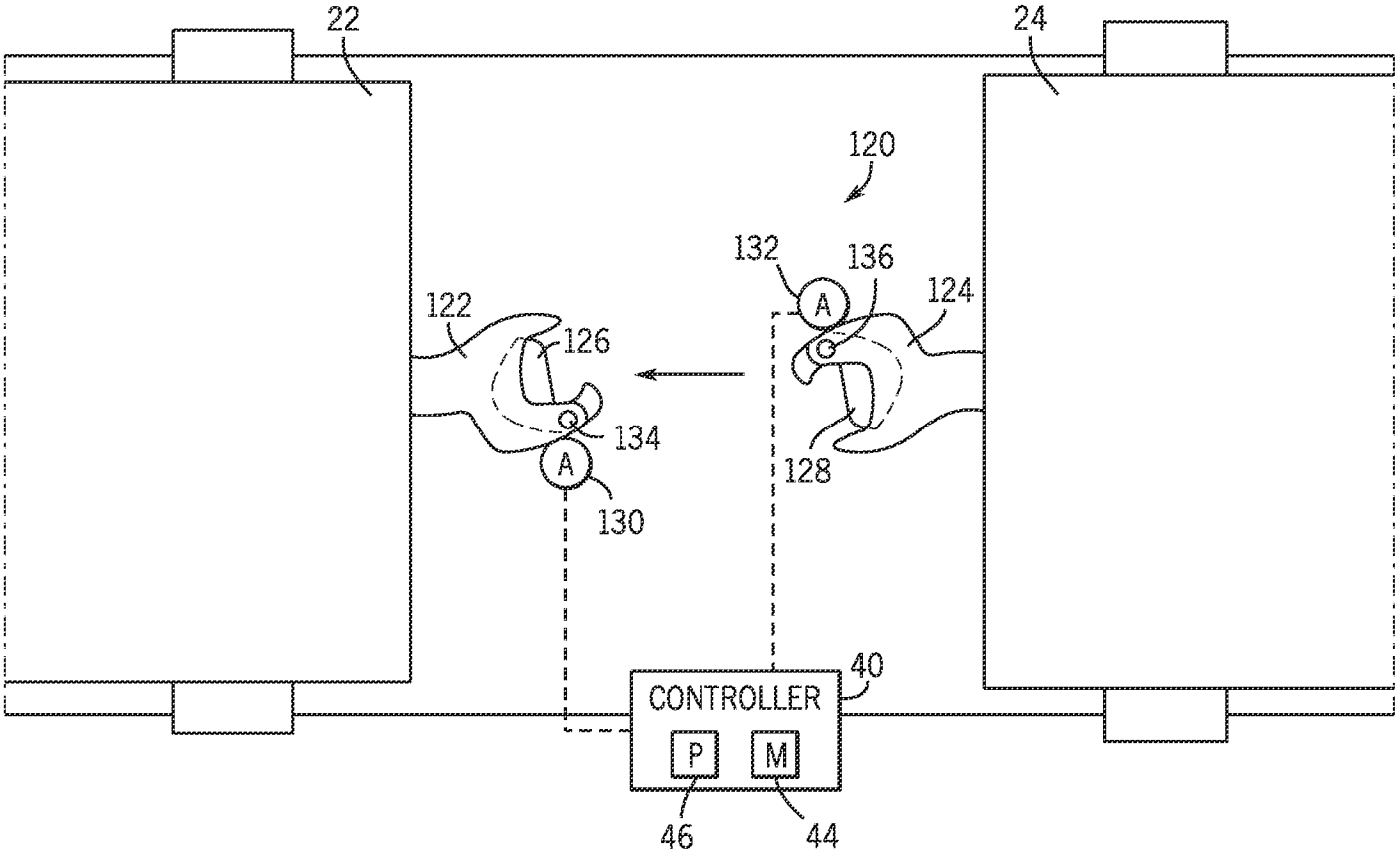
FIG. 9 is a top view of a coupling (e.g., asexual coupling) used for coupling and decoupling a first ride vehicle and a second ride vehicle of a ride vehicle assembly corresponding to the ride system of FIG. 1, in accordance with an aspect of the present disclosure.

FIG. 9 is a top view of another embodiment of an asexual coupling 120 used for coupling and decoupling the first ride vehicle 22 of FIG. 1 and the second ride vehicle 24 of FIG. 1. The asexual coupling 120 may include first linkage 122 coupled to the first ride vehicle 22 (e.g., corresponding to the linkage 48 of the first ride vehicle 22 in FIG. 1) and a second linkage 124 coupled to the second ride vehicle 24 (e.g., corresponding to the linkage 48 of the first ride vehicle 22 in FIG. 1). The first linkage 122 may include a first hook 126 and the second linkage 94 may include a second hook 128. A first actuation assembly 130 may be coupled to the first hook 126 and configured to actuate the first hook 126 in response to receiving a signal from the controller 40. A second actuation assembly 132 may be coupled to the second hook 128 and configured to actuate the second hook 128 in response to receiving a signal from the controller 40. In response to actuation via the controller 40, the first hook 126 may be configured to rotate about a first pivot 134 and the second hook 128 may be configured to rotate about a second pivot 136, thereby securing the first linkage 122 to the second linkage 124. In certain embodiments, one or more magnets (e.g., electromagnets) may be disposed along the interior sides of the first hook 126 and/or the second hook 128, such that the magnets may be activated in response to a coupling of the first linkage 122 with the second linkage 124.

Figure 10:
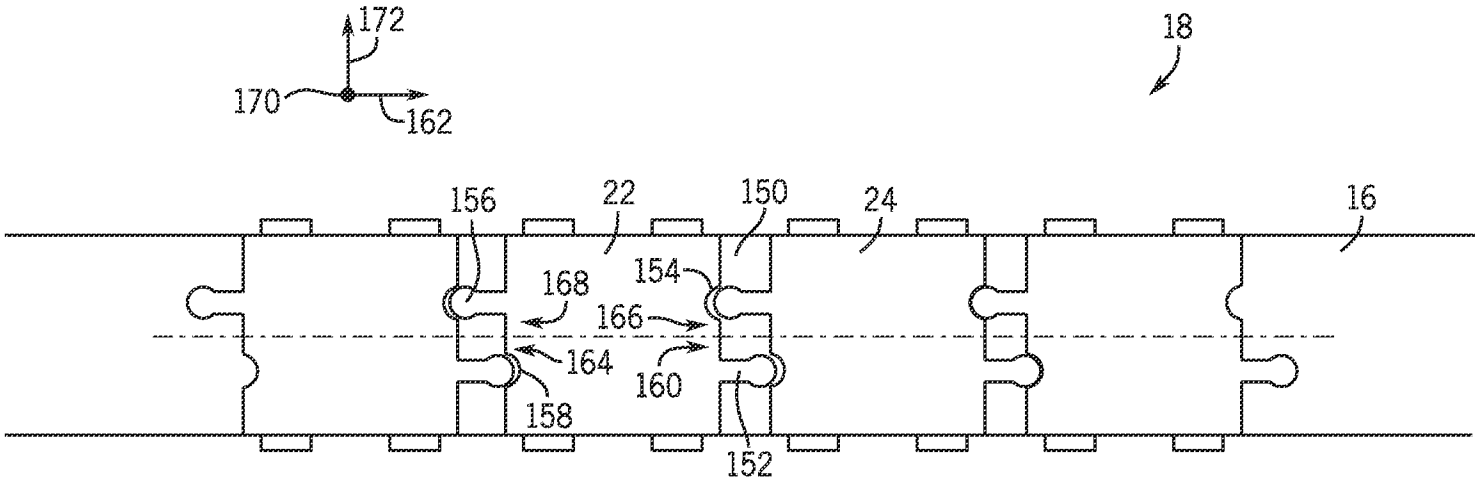
FIG. 10 is a top view of a ride vehicle assembly employing a dual coupling used for coupling and decoupling a first ride vehicle and a second ride vehicle corresponding to the ride system of FIG. 1, in accordance with an aspect of the present disclosure.

FIG. 10 is a top view of an embodiment of the ride vehicle assembly 18 employing a dual coupling 150 used for coupling and decoupling the first ride vehicle 22 of FIG. 1 and the second ride vehicle 24 of FIG. 1. In the illustrated embodiment, the first ride vehicle 22 may include a first linkage 152 (e.g., an extension), a second linkage 154 (e.g., a cavity), a third linkage 156 (e.g., an extension), and a fourth linkage 158 (e.g., a cavity). The first linkage 152 and the second linkage 154 are disposed on a first end 160 (e.g., in longitudinal direction 162) of the first ride vehicle 22, and the third linkage 156 and the fourth linkage 158 are disposed on a second end 164 (e.g., in longitudinal direction 162) of the first ride vehicle 22. The first linkage 152 may be proximate to the second linkage 154, such that the first linkage 152 and the second linkage 154 together form a first dual linkage 166. The third linkage 156 may be proximate to the fourth linkage 158, such that the third linkage 156 and the fourth linkage 158 together form a second dual linkage 168.

In the illustrated embodiment, the first linkage 152 and the third linkage 156 are both ball linkages (e.g., of a ball-and-socket joint), while the second linkage 154 and the fourth linkage 158 are both socket linkages (e.g., of a ball-and-socket joint). In this manner, the first dual linkage 166 is rotated 180 degrees about the vertical axis 170 to obtain the configuration of the second dual linkage 168, such that the first linkage 152 is located in the lower lateral half (e.g., relative to lateral direction 172) of the ride vehicle, and the third linkage 156 is located in the upper lateral half. Similarly, the second linkage 154 is located in the upper lateral half (e.g., relative to lateral direction 172), and the fourth linkage 158 is located in the lower lateral half. It may be appreciated that with this non-symmetrical dual linkage configuration, both the first end 160 and the second end 164 of each ride vehicle may connect to either the first end 160 or second end 164 of any other ride vehicle, thereby enabling the direction of the ride vehicles to be changed during the ride sequence. For example, a ride vehicle may begin the ride facing forward, but may end the ride facing backward, and will still be able to connect with other ride vehicles while facing backwards.

Figure 11:
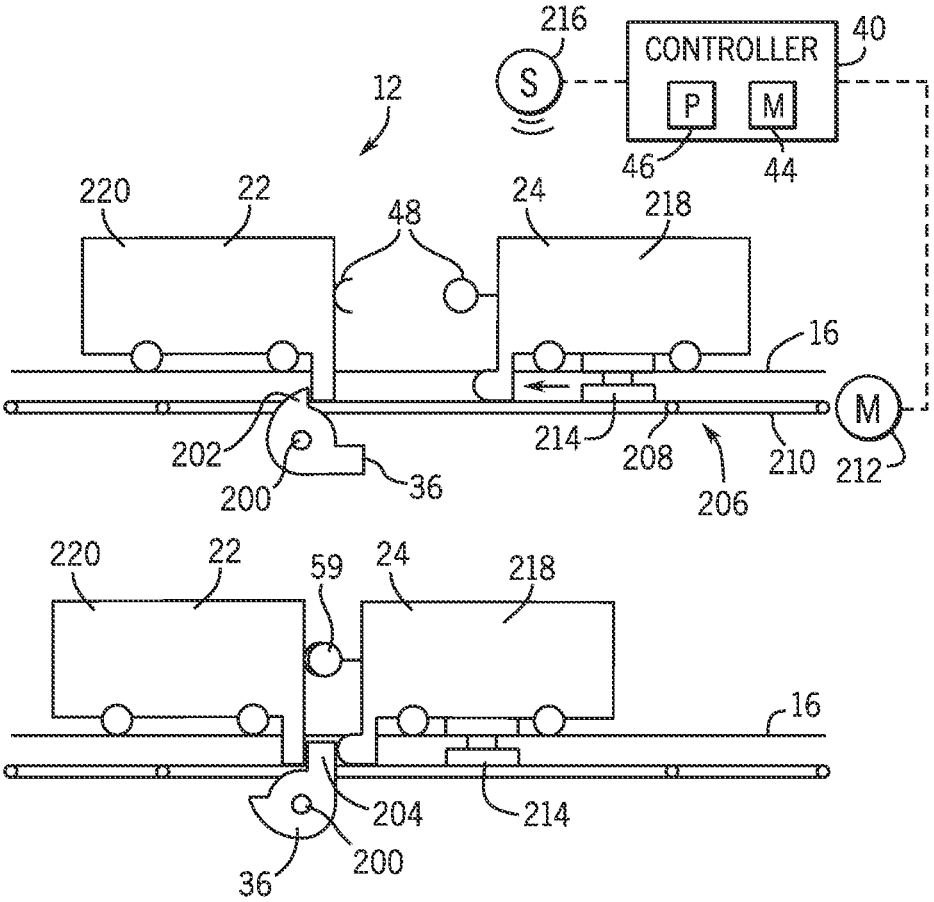
FIG. 11 is a side view of the ride system of FIG. 1, including a stop apparatus and a sliding mechanism used to enable a recoupling of a first ride vehicle and a second ride vehicle of the ride vehicle assembly, in accordance with an aspect of the present disclosure.

FIG. 11 is a side view of an embodiment of the ride system 12 of FIG. 1, including the stop apparatus 36 used to enable a recoupling of the first ride vehicle 22 and the second ride vehicle 24. In the illustrated embodiment, the stop apparatus 36 is connected to the track 16 (e.g., near the ride vehicles). The stop apparatus 36 may be configured to actuate from a first position to a second position when the first ride vehicle 22 makes contact with the stop apparatus 36 (e.g., while the first ride vehicle 22 is moving). The first ride vehicle 22 may slow down via the stop apparatus 36 and/or via a brake disposed on the first ride vehicle 22 or track 16. The stop apparatus 36, upon being actuated to the second position, may be configured to block a forward motion of the second ride vehicle 24 (e.g., via providing a physical barrier). When the second ride vehicle 24 makes contact with the stop apparatus 36, the stop apparatus 36 may be configured to enable a recoupling of the first ride vehicle 22 with the second ride vehicle 24 (e.g., the stop apparatus 36 spaces the ride vehicles so as to enable recoupling). In certain embodiments, more than one stop apparatus 36 (e.g., two stop apparatus, three stop apparatus, etc.) may be used between two successive ride vehicles.

In certain embodiments, the stop apparatus 36 may include a hinge 200, a contact plate 202 (e.g., push plate), and a stopping plate 204. The contact plate 202 may be configured to give way (e.g., move freely or swing) in response to the first ride vehicle 22 moving past (e.g., while also contacting) the contact plate 202. In response to the contact plate 202 being pushed by the first ride vehicle 22, the stop apparatus 36 may be configured to rotate, via the hinge 200, such that a stopping plate 204 of the stop apparatus 36 blocks a forward motion of the second ride vehicle 24. In response to the second ride vehicle 24 contacting the stopping plate 204, the second ride vehicle 24 may stop at the correct distance away from the first ride vehicle 22, such that the first ride vehicle 22 and second ride vehicle 24 are in a condition for coupling. Additionally or alternatively, brakes may be employed on the first ride vehicle 22, the second ride vehicle 24, or both.

In certain embodiments, electromagnets and/or permanent magnets may be used in conjunction with the stop apparatus 36. The stop apparatus 36 may be configured to provide a baseline spacing of the ride vehicles. In the event that the baseline spacing between the ride vehicles is still not sufficient for coupling, electromagnets and/or permanent magnets disposed along the track (e.g., beneath, alongside of) may be used to correct the baseline spacing between successive ride vehicles to a more precise spacing.

In certain embodiments, the controller is configured to receive a signal from the stop apparatus(s) 36 indicating when the stop apparatus(s) 36 are upright and/or retracted. In other embodiments, the controller is configured to send a signal to the stop apparatus(s) 36 for rotating and/or retracting the stop apparatus(s) 36 simultaneously (e.g., preparing for the next ride sequence). In response to receiving the signal from the controller, the stop apparatus(s) 36 may be configured to rotate and/or retract (e.g., via an actuator), thereby allowing the ride vehicle assembly to pass during the next ride sequence.

In certain embodiments, the stop apparatus(s) 36 may include both a mechanical stopper used to block a forward motion of the ride vehicles. For example, the controller may be configured to instruct detection, via a sensor (e.g., load cell, pneumatic load cell, capacitive load cell, strain gauge, force sensing resistor, proximity, laser, camera, etc.) disposed in the locality of the track, of when a ride vehicle is at a particular location. In response to the controller determining that a ride vehicle is in a given location (e.g., via the sensor), the controller may send a signal to an actuator instructing a mechanical stopper to actuate, thereby blocking a forward motion of a subsequent ride vehicle.

In certain embodiments, a sliding mechanism 206 (e.g., sliding plate) may be used in conjunction with the stop apparatus(s) 36 for coupling successive ride vehicles. The sliding mechanism 206 may be disposed beneath (e.g., along, besides, etc.) the track 16 and may include two or more pulleys 208, a chain 210 (e.g., belt), and one or more motors 212. The chain 210 may wrap around the pulleys 208 and may be configured to be driven by the motors 212. The sliding mechanism 206 may also include a grasping mechanism 214 (e.g., grasping electromagnet) coupled to the chain 210 and configured to couple and decouple to a location beneath (e.g., or on the side of) each ride vehicle. In the illustrated embodiment, the grasping mechanism 214 is an electromagnet configured to attract an electromagnet coupled to an underside of the ride vehicle. In other embodiments, the grasping mechanism may be a hook, clamp, or other mechanical mechanism. Upon the grasping mechanism 214 coupling to a ride vehicle, the sliding mechanism 206 is configured to move the ride vehicle to another location on the track 16.

As part of the operation of the sliding mechanism 206, data from a sensor 216 (e.g., load cell, pneumatic load cell, capacitive load cell, strain gauge, force sensing resistor, proximity, laser, camera, etc.) may be used to detect a location of a ride vehicle 218 entering a loading segment of the track 220 (e.g., passenger loading station). After the ride vehicle 218 comes to a stop (e.g., via brakes), the sensor 216 may send a signal to a controller 40 indicative of the location of the ride vehicle 218. In response to receiving the signal from the sensor 216, the controller 40 may instruct the one or more motors 212 of the sliding mechanism 206 to move the grasping mechanism 214 to the location of the ride vehicle 218. In response to the grasping mechanism 214 reaching the location of the ride vehicle 218 (e.g., via the sliding mechanism 206), the controller 40 may instruct the grasping mechanism 214 (e.g., via activating an electromagnet) to engage with the ride vehicle 218. In response to the grasping mechanism 214 successfully engaging the ride vehicle 218, the sliding mechanism 206 may move the ride vehicle 218 to predetermined location on the track 16. The predetermined location may enable the ride vehicle 218 to successfully couple to a preceding ride vehicle 220 (e.g., a ride vehicle already in loading station) via the coupling 59. In response to a successful engagement of ride vehicle 218 with the preceding ride vehicle 220 via the coupling 59, the controller 40 may instruct the grasping mechanism 214 to disengage from the ride vehicle 218, such that the sliding mechanism 206 is on standby for a next ride vehicle. While the illustrated embodiment shows the sliding mechanism 206 being used in conjunction with the stop apparatus 36, it should be understood that the sliding mechanism 206 may also be used in place of the stop apparatus 36. In an embodiment, the stop apparatus 36 may be used without the sliding mechanism 206. In an embodiment, the stop apparatus 36 may be used in conjunction with an energy management assembly (e.g., the same energy management assembly used during or after decoupling, a separate energy management assembly). In an embodiment, coupling may be enabled by positioning the ride vehicles 218, 220 with an energy management assembly and without a stop apparatus 36.

In certain embodiments, the first ride vehicle 22 may couple with the second ride vehicle 24 in response to the first ride vehicle 22 being joined with the second ride vehicle 24 (or vice versa), thereby causing a joining of the mechanical linkages 48 of the first and second ride vehicles 22, 24. In certain embodiments, the first ride vehicle 22 and/or second ride vehicle 24 may be slowed prior to coupling via the energy management assembly. In certain embodiments, the stop apparatus 36 and/or the sliding mechanism 206 may be used for coupling of ride vehicles. In other embodiments, any combination of the energy management assembly, stop apparatus, and sliding mechanism may be used for coupling of the ride vehicles.

Figure 12:
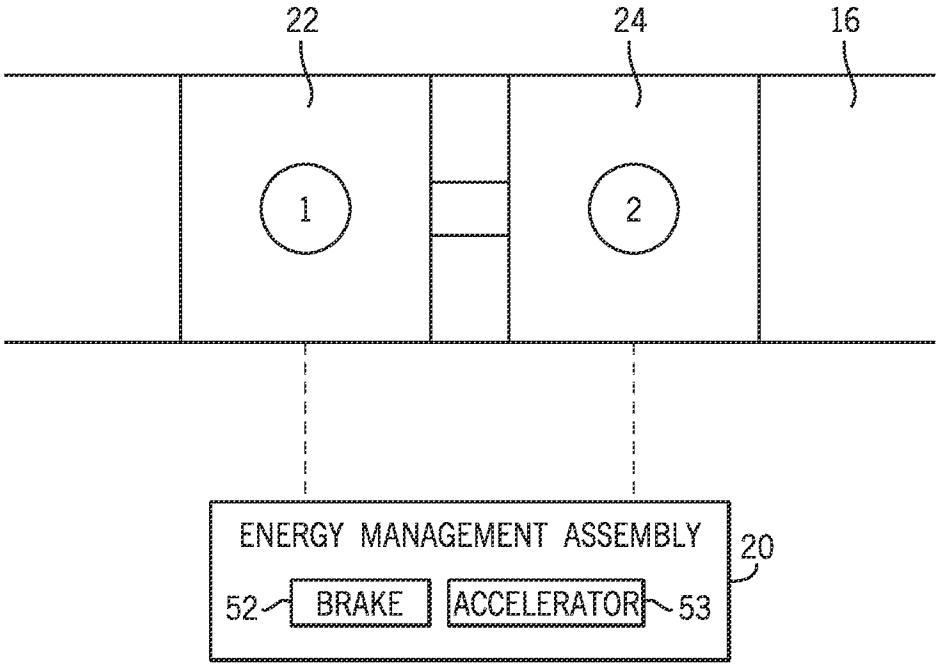
FIG. 12 is a top view of the ride system of FIG. 1, including an energy management assembly used for coupling the first ride vehicle and the second ride vehicle, in accordance with an aspect of the present disclosure.

FIG. 12 is a top view of an embodiment the ride system 12 of FIG. 1, including the energy management assembly 20, which may be used for coupling the first ride vehicle 22 and the second ride vehicle 24. As shown, the energy management assembly 20 may include the brake 52 and/or the accelerator 53. The accelerator 53 may include drive wheels disposed on the track 16 (e.g., configured to propel the ride vehicles 22, 24), a linear induction motor (LIM), a linear synchronous motor (LSM), or a combination thereof. Additionally or alternatively, the brake 52 may include drive wheels disposed on the track 16 (e.g., configured to brake or slow down the ride vehicles 22, 24), a linear induction motor (LIM), a linear synchronous motor (LSM), or a combination thereof. In certain embodiments, the brake 52 and the accelerator 53 may be a single integrated component. That is, the energy management assembly 20 may include a single component that decelerates and accelerates the first ride vehicle 22 and/or the second ride vehicle 24. In certain embodiments, the energy management assembly 20 may be configured to couple and/or decouple the first ride vehicle 22 and the second ride vehicle 24 via accelerating the first ride vehicle 22, decelerating the second ride vehicle 24, or a combination thereof. Additionally or alternatively, the energy management assembly 20 may be configured to couple and/or decouple the first ride vehicle 22 and the second ride vehicle 24 via decelerating the first ride vehicle 22, accelerating the second ride vehicle 24, or a combination thereof. Furthermore, the energy management assembly 20 may be configured to couple and/or decouple the first ride vehicle 22 and the second ride vehicle 24 via concurrently accelerating and/or concurrently decelerating the first ride vehicle 22 and the second ride vehicle 24.

Figure 13:
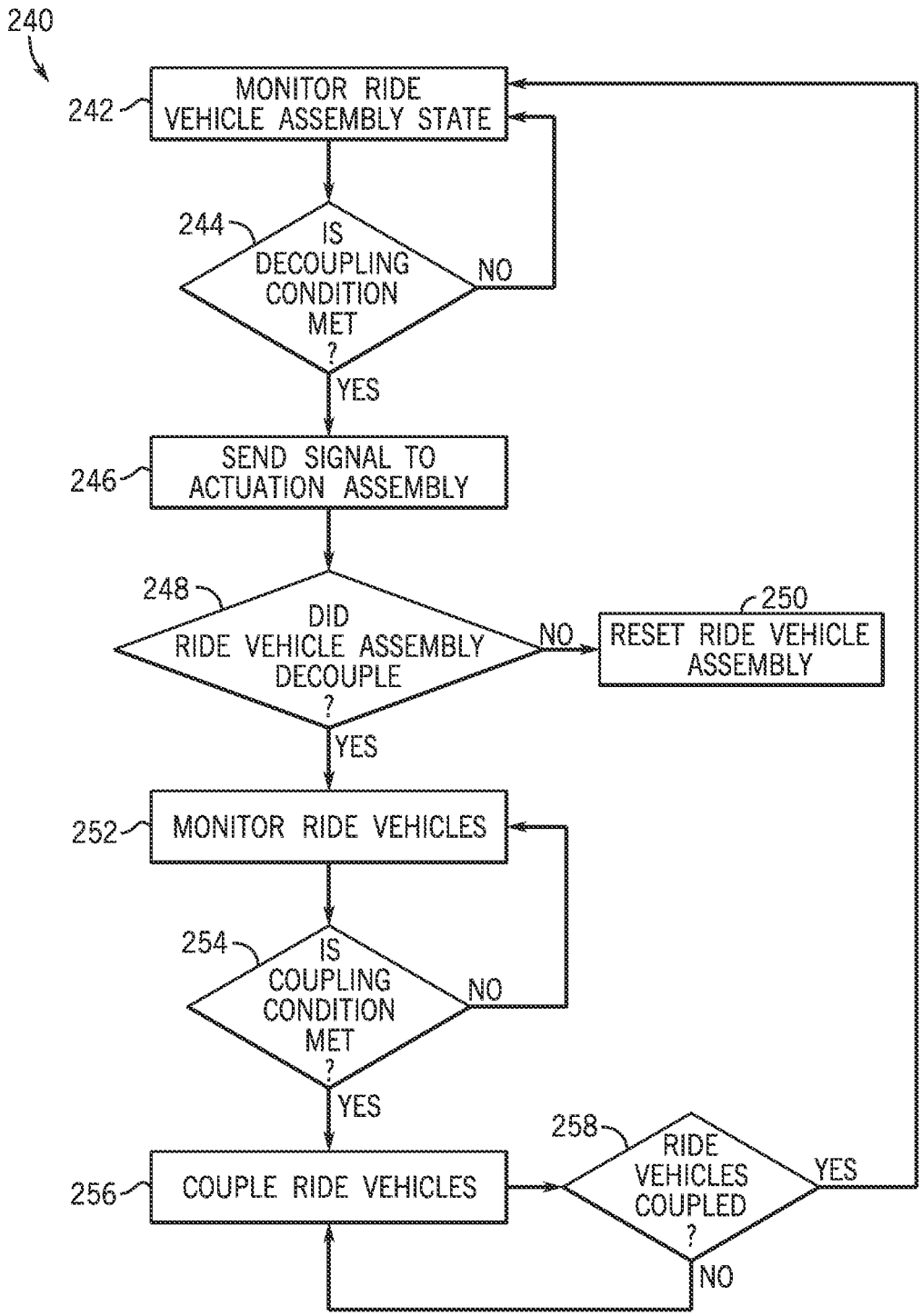
FIG. 13 is a flowchart of a method employed to operate the ride system of FIG. 1, in accordance with an aspect of the present disclosure.

FIG. 13 is a flowchart of an embodiment of a method 240 that may be used to operate the ride system. In the illustrated embodiment, the method 240 includes monitoring (block 242) the state of the ride vehicle assembly (e.g., via a controller and/or sensors). Monitoring the state of the ride vehicle assembly may include determining a position characteristic, a load characteristic (e.g., mass moment of inertia, mass, force, torque, etc.), or both, of the ride vehicle assembly.

The method 240 also includes determining (block 244), via the controller, whether a condition for decoupling the ride vehicles is met (e.g., using a threshold position characteristic, a threshold load characteristic, or both). If the controller determines that the decoupling condition is not met, the method 240 proceeds back to block 242 and the controller continues monitoring the state of the ride vehicle assembly. In response to the controller determining that the decoupling condition is met, the method 240 includes instructing (block 246), via the controller, the actuation of one or more actuation assemblies (e.g., send a signal to the one or more actuation assemblies).

The method 240 also includes verifying (block 248), via the controller, that the two ride vehicles successfully decoupled in response to receiving a signal (e.g., indicating a successful decoupling) from the one or more actuation assemblies or some other componentry. The method 240 includes resetting (block 250) the ride vehicle assembly in response to the controller determining that the ride vehicles have not successfully decoupled (e.g., controller does not receive a signal from the one or more actuation assemblies indicating a successful decoupling). In certain embodiments, resetting the ride vehicle assembly may include sending repeated signals to the one or more actuation assemblies, restarting the ride sequence, or setting off an alert/alarm.

The method 240 also includes monitoring (block 252), via the controller, the states of the separated ride vehicles in response to determining that the ride vehicles have successfully decoupled. In some embodiments, the separated ride vehicles may be directed on different paths (e.g., track segments) and/or in different directions, as previously described. The method 240 also includes determining (block 254), via the controller, whether the separated ride vehicles meet a coupling condition (e.g., engagement condition). In some embodiments, block 254 may occur at or adjacent to a loading or unloading station. The coupling condition may be determined using a position characteristic of the first ride vehicle and/or the second ride vehicle (e.g., determined by a sensor or encoder), a signal from a sensor (e.g., proximity, load cell, etc.), energy management conditions of the first and/or second ride vehicle, or any combination thereof. In certain embodiments, the controller may be configured to send a signal to magnets (e.g., permanent magnets, electromagnets) disposed along the track configured to align the ride vehicles such that the ride vehicles may be coupled. For example, the magnets may attract the ride vehicles via ferrous material (e.g., iron, steel) disposed about the ride vehicles. The controller may send a signal to consecutive magnets disposed on the track such that the magnets guide one or more ride vehicles toward each other (e.g., via drive wheels coupled to the ride vehicles) until the linkages of the ride vehicles make contact, thereby aligning (e.g., engaging) the linkages of the couplings of one or more ride vehicles.

The method 240 also includes coupling (block 256), under instruction from the controller. In response to determining that the coupling condition is met, the first ride vehicle and the second ride vehicle are coupled by actuating the one or more actuation assemblies (e.g., via a signal to the one or more actuation assemblies). The method 240 also includes verifying (block 258), via the controller, that the coupling of the first ride vehicle and the second ride vehicle is successful. In certain embodiments, the controller may receive one or more signals from one or more sensors (e.g., load cell, pneumatic load cell, capacitive load cell, strain gauge, force sensing resistor, proximity, laser, camera, etc.) indicating that the coupling of the ride vehicles is successful. If the controller determines that the coupling is not successful, the controller may be configured to continue to instruct the one or more actuation assemblies to attempt to couple the ride vehicles. In certain embodiments, the controller may be configured to output an alert if the coupling of the ride vehicles is not successful.

In certain embodiments, the controller is configured to instruct the engagement (e.g., interlocking) of a portion of the linkage of the first ride vehicle with another portion of the linkage of the second ride vehicle when both ride vehicles are on a particular interval of the track. In response to receiving a signal indicating that the first and second portions of the coupling are engaged, the controller may be configured to instruct actuation of coupling, thereby coupling the first ride vehicle and the second ride vehicle.

While the above embodiments primarily pertain to ground ride vehicles, the same embodiments may apply to other types of vehicles (e.g., water vehicles, air vehicles). For example, the ride vehicle assembly may float on water while guided along a certain path through the water via a track.

While only certain features of the invention have been illustrated and described herein, many modifications and changes will occur to those skilled in the art. It is, therefore, to be understood that the appended claims are intended to cover all such modifications and changes as fall within the true spirit of the invention.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for (perform)ing (a function) . . . " or "step for (perform)ing (a function) . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A ride system, comprising:

a track;

a ride vehicle assembly comprising a first ride vehicle configured to move along the track and a second ride vehicle configured to move along the track;

a coupling between the first ride vehicle and the second ride vehicle, wherein the coupling is configured to block a decoupling of the first ride vehicle from the second ride vehicle in response to the ride vehicle assembly being in a first interval of the track, and wherein the coupling is configured to be actuated to cause the decoupling of the first ride vehicle from the second ride vehicle in response to at least the ride vehicle assembly being in a second interval of the track different than the first interval; and an actuation assembly configured to actuate the coupling to cause the decoupling of the first ride vehicle from the second ride vehicle in response to at least the ride vehicle assembly being in the second interval of the track different than the first interval such that, upon the decoupling, the first ride vehicle moves in a first direction along the track and the second ride vehicle moves in a second direction along the track, wherein the second direction is opposite to the first direction.

2. The ride system of claim 1, comprising:

a third ride vehicle of the ride vehicle assembly, wherein the third ride vehicle is coupled to the first ride vehicle such that the first ride vehicle is between the second ride vehicle and the third ride vehicle;

a fourth ride vehicle of the ride vehicle assembly, wherein the fourth ride vehicle is coupled to the second ride vehicle such that the second ride vehicle is between the first ride vehicle and the fourth ride vehicle;

a first axle corresponding to the first ride vehicle; and a second axle corresponding to the first ride vehicle.

3. The ride system of claim 1, comprising a controller configured to:

receive an indication of a position characteristic corresponding to the ride vehicle assembly; and control the actuation assembly based on the position characteristic.

4. The ride system of claim 1, wherein the actuation assembly is configured to actuate the coupling in response to a load characteristic associated with the ride vehicle assembly meeting a pre-defined relationship with a threshold load characteristic and the ride vehicle assembly being positioned in the second interval of the track to cause the decoupling of the first ride vehicle from the second ride vehicle.

5. The ride system of claim 4, wherein the ride system is configured such that the ride vehicle assembly comprises an additional load characteristic that does not meet the pre-defined relationship with the threshold load characteristic while the ride vehicle assembly is in the first interval of the track.

6. The system of claim 5, wherein the load characteristic or the additional load characteristic comprise:

a mass moment of inertia of the ride vehicle assembly;

a force exerted by the ride vehicle assembly;

a torque exerted by the ride vehicle assembly; or any combination thereof.

7. The ride system of claim 1, comprising:

a first track segment;

a second track segment coupled to the first track segment;

a third track segment coupled to the first track segment; and a switch configured to be actuated between:

a first configuration configured to direct the first ride vehicle, the second ride vehicle, or a combination thereof from the first track segment onto the second track segment; and a second configuration configured to direct the first ride vehicle, the second ride vehicle, or the combination thereof from the first track segment onto the third track segment.

8. The ride system of claim 7, comprising an energy management assembly configured to speed up the first ride vehicle, slow the second ride vehicle, or both to generate a gap between the first ride vehicle and the second ride vehicle after the first ride vehicle is decoupled from the second ride vehicle.

9. The ride system of claim 8, wherein the energy management assembly comprises a brake configured to slow down the second ride vehicle.

10. The ride system of claim 1, wherein the track comprises:

a first track segment; and a second track segment, wherein:

the second interval of the track is coupled to and between the first track segment and the second track segment; and the actuation assembly is configured to actuate the coupling to cause the decoupling of the first ride vehicle from the second ride vehicle in response to at least the ride vehicle assembly being in the second interval of the track such that the first ride vehicle is directed onto the first track segment and the second ride vehicle is directed onto the second track segment.

11. The ride system of claim 1, wherein the coupling comprises:

a first linkage;

a second linkage, wherein the second linkage is configured to engage with the first linkage; and a mechanism comprising a rack and a pinion, wherein the mechanism is configured to couple the first linkage to the second linkage in response to an extension of the rack, wherein the mechanism is configured disengage the first linkage from the second linkage in response to a retraction of the rack.

12. The ride system of claim 1, wherein the actuation assembly is configured to actuate the coupling to couple the first ride vehicle and the second ride vehicle.

13. The system of claim 1, wherein the first direction is a forward direction along the track and the second direction is a backward direction along the track.

14. A ride system, comprising:

a ride path;

a ride vehicle assembly comprising a first ride vehicle configured to move along the ride path and a second ride vehicle configured to move along the ride path;

a coupling between the first ride vehicle and the second ride vehicle;

an actuation assembly configured to actuate the coupling to cause a decoupling of the first ride vehicle from the second ride vehicle; and a controller configured to instruct the actuation assembly to actuate the coupling to cause the decoupling of the first ride vehicle from the second ride vehicle in response to a position characteristic of the ride vehicle assembly, a load characteristic of the ride vehicle assembly, or both such that, upon the decoupling, the first ride vehicle moves in a first direction along the ride path and the second ride vehicle moves in a second direction along the ride path, wherein the second direction is opposite to the first direction.

15. The ride system of claim 14, comprising a sensor configured to detect the position characteristic of the ride vehicle assembly, wherein the controller is configured to instruct the actuation assembly to actuate the coupling to cause the decoupling of the first ride vehicle from the second ride vehicle in response to the position characteristic meeting a pre-defined relationship with a threshold position characteristic.

16. The ride system of claim 14, wherein:

the ride path comprises a first ride segment and a second ride segment joined to form a hill having a peak; and the controller is configured to instruct the actuation assembly to actuate the coupling to cause the decoupling of the first ride vehicle and the second ride vehicle in response to the position characteristic indicating that the ride vehicle assembly is at or adjacent the peak.

17. The ride system of claim 16, comprising an energy management assembly configured to cause:

the first ride vehicle to travel in the first direction along the first ride segment in response to the decoupling of the first ride vehicle and the second ride vehicle; and the second ride vehicle to travel in the second direction along the second ride segment in response to the decoupling of the first ride vehicle and the second ride vehicle.

18. The ride system of claim 17, wherein the energy management assembly is configured to couple the first ride vehicle and the second ride vehicle via a braking of the first or second ride vehicles, an acceleration of the first or second ride vehicles, or a combination thereof.

19. A method of operating a ride system, the method comprising:

joining, via a coupling, a first ride vehicle and a second ride vehicle of a ride vehicle assembly, wherein the ride vehicle assembly is moveable along a ride path;

determining, via a controller, a position of the ride vehicle assembly along the ride path;

determining, via the controller, whether the position of the ride vehicle assembly along the ride path meets a pre-defined relationship with a threshold position of the ride vehicle assembly along the ride path;

controlling, via the controller and in response to determining that the position meets the pre-defined relationship with the threshold position, an actuation assembly corresponding to the coupling to cause the first ride vehicle to be decoupled from the second ride vehicle;

causing the first ride vehicle to travel in a first direction along the ride path based on the first ride vehicle decoupling from the second ride vehicle; and causing the second ride vehicle to travel in a second direction along the ride path based on the first ride vehicle decoupling from the second ride vehicle, wherein the first direction is opposite the second direction.

20. The method of claim 19, comprising instructing, via the controller, an actuation of a switch between:

a first ride configuration in which a first track segment is joined with a second track segment to cause the first ride vehicle to move from the first track segment to the second track segment; and a second ride configuration in which the first track segment is joined with a third track segment to cause the second ride vehicle to move from the first track segment to the third track segment.

21. The method of claim 20, comprising:

operating, via the controller, an energy management assembly such that a gap is formed between the first ride vehicle and the second ride vehicle; and instructing, via the controller, the actuation of a switch in response to the gap being aligned with a juncture between a first ride segment and a second ride segment.

22. The method of claim 21, comprising coupling the first ride vehicle and the second ride vehicle via the energy management assembly via a braking of the first or second ride vehicles, an acceleration of the first or second ride vehicles, or a combination thereof.

* * * * *